US011189256B2

(12) United States Patent
Pawlovich

(10) Patent No.: US 11,189,256 B2
(45) Date of Patent: Nov. 30, 2021

(54) INTEGRAL DRUM BODY SYSTEM FOR PERCUSSION INSTRUMENT

(71) Applicant: Daniel Pawlovich, Costa Mesa, CA (US)

(72) Inventor: Daniel Pawlovich, Costa Mesa, CA (US)

( * ) Notice: Subject to any disclaimer, the term of this patent is extended or adjusted under 35 U.S.C. 154(b) by 0 days.

(21) Appl. No.: 16/702,308

(22) Filed: Dec. 3, 2019

(65) Prior Publication Data

US 2020/0105234 A1 Apr. 2, 2020

Related U.S. Application Data

(63) Continuation of application No. 15/993,250, filed on May 30, 2018, now Pat. No. 10,497,345.

(60) Provisional application No. 62/587,771, filed on Nov. 17, 2017.

(51) Int. Cl.

| | |
|---|---|
| ***G10D 13/22*** | (2020.01) |
| ***G10D 13/02*** | (2020.01) |
| ***G10D 13/16*** | (2020.01) |
| ***G10D 13/18*** | (2020.01) |

(52) U.S. Cl.

CPC ..... *G10D 13/22* (2020.02); *G10D 13/02* (2013.01); *G10D 13/16* (2020.02); *G10D 13/18* (2020.02)

(58) Field of Classification Search

CPC ..... G10D 13/22

See application file for complete search history.

(56) References Cited

U.S. PATENT DOCUMENTS

| | | | | |
|---|---|---|---|---|
| 1,589,887 A | | 6/1926 | Logan | |
| D165,622 S | | 1/1952 | Witmer | |
| 2,834,244 A | | 5/1958 | Willits | |
| 3,139,783 A | | 7/1964 | Grant et al. | |
| 3,674,911 A | | 7/1972 | Phillips et al. | |
| 4,102,236 A | * | 7/1978 | North | G10D 13/22 84/411 R |

(Continued)

FOREIGN PATENT DOCUMENTS

JP 2018146665 A 9/2018

OTHER PUBLICATIONS

3D Printing Snare Drums, Stratasys Direct Manufacturing, Created Sep. 9, 2019. 2019.*

(Continued)

*Primary Examiner* — Robert W Horn

(74) *Attorney, Agent, or Firm* — Dorsey & Whitney LLP

(57) ABSTRACT

The present disclosure relates generally to a drum apparatus with advanced acoustic response and methods of manufacturing the drum apparatus. The drum apparatus includes an integral drum body having a side wall defining a resonant chamber. The integral drum body is formed by an additive manufacturing process or with a volume printing material that shapes the side wall to define an acoustic response of the drum apparatus. The side wall is shaped to define a top perimeter region and a bottom region of the integral drum body. The top perimeter region defines a top opening to the resonant chamber and the bottom region defines a bottom of the resonant chamber, opposite the top perimeter region. The side wall has a thickness or mass distribution controlled by the additive manufacturing process or defined by the volume printing material to modulate the acoustic response of the drum apparatus.

21 Claims, 10 Drawing Sheets

(56) References Cited

U.S. PATENT DOCUMENTS 4,134,324 A 1/1979 Lemert
4,210,620 A * 7/1980 von Holdt ..... B29C 45/0017 264/163
4,254,685 A 3/1981 Rose
4,286,766 A * 9/1981 von Holdt ..... B29C 45/4421 249/144
4,475,434 A 10/1984 Willis
4,575,330 A * 3/1986 Hull ..... G09B 25/02 425/174.4
4,993,304 A 2/1991 Lovelet
D316,090 S 4/1991 Holloway et al.
5,377,576 A 1/1995 Good et al.
5,536,161 A * 7/1996 Smith ..... B29C 33/444 425/438
5,544,561 A 8/1996 Isomi
5,587,544 A 12/1996 Fujii et al.
5,855,836 A * 1/1999 Leyden ..... B29C 64/112 264/401
6,305,769 B1 * 10/2001 Thayer ..... B29C 64/40 347/1
6,380,468 B1 4/2002 Shigenaga et al.
6,462,262 B2 10/2002 Hagiwara
6,515,208 B2 * 2/2003 Cleland ..... G10D 13/22 84/411 R
6,921,854 B2 * 7/2005 Gatzen ..... G10D 13/22 84/411 R
7,261,542 B2 * 8/2007 Hickerson ..... B29C 64/379 425/174.4
7,307,205 B2 * 12/2007 Balma ..... G10D 13/22 84/411 R
7,361,823 B2 4/2008 Rush
7,402,739 B2 * 7/2008 Balma ..... G10D 13/22 84/411 R
7,446,250 B1 11/2008 Van
7,473,835 B2 * 1/2009 Balma ..... G10D 13/22 84/411 R
7,498,498 B2 * 3/2009 Lerner ..... G10D 13/02 84/411 R
7,692,082 B2 * 4/2010 Abe ..... G10D 13/22 84/411 R
7,781,657 B2 * 8/2010 Nickel ..... G10D 13/22 84/411 R
7,812,236 B1 * 10/2010 Good ..... G10D 13/22 84/411 R
7,888,574 B1 * 2/2011 Acoutin ..... G10D 13/02 84/411 R
8,035,018 B2 10/2011 Bausch
D649,080 S 11/2011 Neary
8,399,754 B2 3/2013 Koks
8,629,340 B1 1/2014 Martin et al.
8,791,347 B1 * 7/2014 Christian ..... G10D 13/22 84/411 R
8,816,178 B2 * 8/2014 Gelb ..... G10D 13/10 84/411 R
8,853,514 B2 10/2014 Cox, Jr.
9,076,414 B1 * 7/2015 Dunnett ..... G10D 13/22
9,214,142 B2 12/2015 May
D747,659 S 1/2016 Coin
9,286,866 B2 * 3/2016 Fugate ..... G10D 13/10
9,286,867 B1 * 3/2016 Oliver ..... G10D 13/03
9,293,122 B1 3/2016 Martin et al.
9,373,310 B2 6/2016 Martin et al.
9,378,715 B2 * 6/2016 Nigro ..... G10D 13/02
9,583,082 B1 2/2017 Martin et al.
9,666,172 B1 * 5/2017 Voelker ..... G10D 13/02
9,873,798 B2 * 1/2018 O'Brien ..... C09D 4/00
10,199,019 B2 * 2/2019 Voelker ..... G10D 13/10
10,418,006 B2 * 9/2019 Ohmuro ..... B32B 21/042
D868,145 S * 11/2019 Pawlovich ..... D17/22
10,497,345 B2 * 12/2019 Pawlovich ..... G10D 13/18
10,621,961 B1 * 4/2020 Weld ..... G10D 13/24
10,699,682 B1 * 6/2020 Allen ..... G10D 13/20
2002/0029680 A1 3/2002 Cleland
2005/0188816 A1 9/2005 May
2008/0053291 A1 * 3/2008 Dunnett ..... G10D 13/10 84/411 R
2008/0127804 A1 6/2008 Lashbrook et al.
2008/0173158 A1 7/2008 Lee
2009/0038465 A1 * 2/2009 Whalley ..... G10D 13/22 84/415
2011/0030531 A1 2/2011 Nakata et al.
2011/0308375 A1 12/2011 Fabas et al.
2014/0053707 A1 * 2/2014 Belli ..... G10D 13/02 84/411 R
2014/0076121 A1 * 3/2014 Carr ..... G10D 13/22 84/411 R
2014/0123831 A1 5/2014 Dunnett
2015/0059553 A1 * 3/2015 Martin ..... G10D 13/14 84/413
2015/0107440 A1 4/2015 Bedson
2016/0217776 A1 * 7/2016 Balma ..... G10D 13/22
2017/0040005 A1 2/2017 Welch
2018/0345547 A1 * 12/2018 Naber ..... B29C 45/0046
2019/0156797 A1 * 5/2019 Pawlovich ..... G10D 13/02
2020/0265815 A1 * 8/2020 Meliti ..... G10D 13/24

OTHER PUBLICATIONS

PCT, , "International Search Report and Written Opinion", Application No. PCT/US2018/061606, dated May 6, 2019, 12 pages.
SJC Custom Drums, , "Product Guide Summer 2017", https://cdn.shopify.com/s/files/1/0863/6884/files/SJC_Product_Guide_-_Summer_2017.pdf, 2017, 27 pages.

* cited by examiner

INTEGRAL DRUM BODY SYSTEM FOR PERCUSSION INSTRUMENT

CROSS-REFERENCE TO RELATED APPLICATION

This application claims priority to International as a continuation of U.S. patent application Ser. No. 15/993,250, filed May 30, 2018, and issued Dec. 3, 2019 as U.S. Pat. No. 10,497,345, which claims priority to U.S. Provisional Application No. 62/587,771, filed Nov. 17, 2017, entitled INTEGRAL DRUM BODY SYSTEM FOR PERCUSSION INSTRUMENT, each of which is incorporated by reference herein, in the entirety and for all purposes.

FIELD

This application relates to percussion instruments, including drum systems adapted for a range of musical styles. More generally, the application relates to drum body systems with advanced acoustic response, suitable for use in high-demand performance settings.

BACKGROUND

Drums are among the oldest and most varied instruments of musical expression. The earliest-known percussion instruments date back to at least the sixth century BC, including richly ornamented cultural artifacts for us in highly ritualistic cultural performances, as well as richly crafted, technically sophisticated and acoustically rich instruments for broader artistic expression. Complex, individualized drumming performances are also well-known among other primates, and a range of other animal species utilize drumming to communicate warnings and other information.

Structurally, drums are typically constructed of a generally hollow frame, shell, or body component, which defines a resonant chamber or acoustic cavity, in communication with one or more drum heads or skins, which define an acoustic membrane or resonator. The drum body can vary widely in configuration, from round or hemispherical to generally oblate in form, and including both complex, multiple-tapered structures as well as frustoconical and cylindrical geometries, with a range of tall, short, narrow and wider aspect ratios.

Typically, a drum head is coupled to the body across an opening defined at one or both ends, and stretched or tensioned to tune the natural modes of the acoustic membrane to match the frequency response of the resonant cavity, or to provide an unmatched frequency response associated with a desired tonal variation. The drum can then be played by striking the head to excite the acoustic membrane, either using the hand or with a drumstick, mallet, brush, kick pedal, or other mechanical device.

The drum can also be left open at one or both ends, or drum heads can be attached on both sides and independently struck, or excited by sympathetic vibrations or resonance. Drums can also be played by striking the main body along the side, or by hitting the rim structure extending around the drum head. Additional acoustic elements such as snares, baffles, zils, ports and mufflers can also be provided, and adapted to modulate, dampen or otherwise modify the acoustic response.

Modern band musicians and classical symphonists are typically trained in a wide range of snare, bass, and timpani drum designs, along with xylophones, bells, chimes, gongs, cymbals, and other "ideophone" (non-drum) percussion instruments. Rock drummers usually perform on a set of snare, tom, tenor, and bass drum (or kick drum) instruments, with a combination of crash, ride, and high-hat cymbal sets. Increasingly, cross-genre performers also incorporate other traditional and non-traditional instruments into their on-stage and studio performances, including bongos, congas, frame drums, talking drums, steel drums, pans, water drums, tabor, tanggu, taiko or wadaiko, and ashiko instruments, in a variety of traditional, modern, classical, pop, punk, baroque, heavy metal, hip-hop, synth-pop, emo and alternative musical styles.

While some of these percussion instruments may naturally require the use of traditional methods and materials, there also is a constant need for new and improved approaches to drum system design. In particular, there is a need for more advanced instrument designs with improved acoustic response adaptable to a wider range of different drum body configurations and performance styles, and more advanced mechanical features to provide greater design flexibility, performance, structural integrity, durability and service life.

SUMMARY

An improved drum apparatus includes an integral drum body having a side wall or drum shell defining a resonant chamber therein. As described herein, a plurality of tension lug bodies or similar coupling structures can be disposed about the circumference of the drum body side wall, and adapted for engaging a drum head across an open end of the drum body, in acoustic communication with the resonant chamber. The drum body side wall and coupling structures are formed of a substantially continuous material, defining an integral structure of the drum body, with desired acoustic response and performance features.

Suitable methods of manufacture of such a drum system or percussion instrument include one or more steps of forming a drum body of a substantially continuous material, e.g., with the drum body having a drum shell defining a resonant chamber, and forming a plurality of tension lug bodies of the substantially continuous material. The tension lug bodies can be disposed about a circumference of the drum shell, in acoustic and mechanical coupling with the drum body.

DETAILED DESCRIPTION

Figure 1:
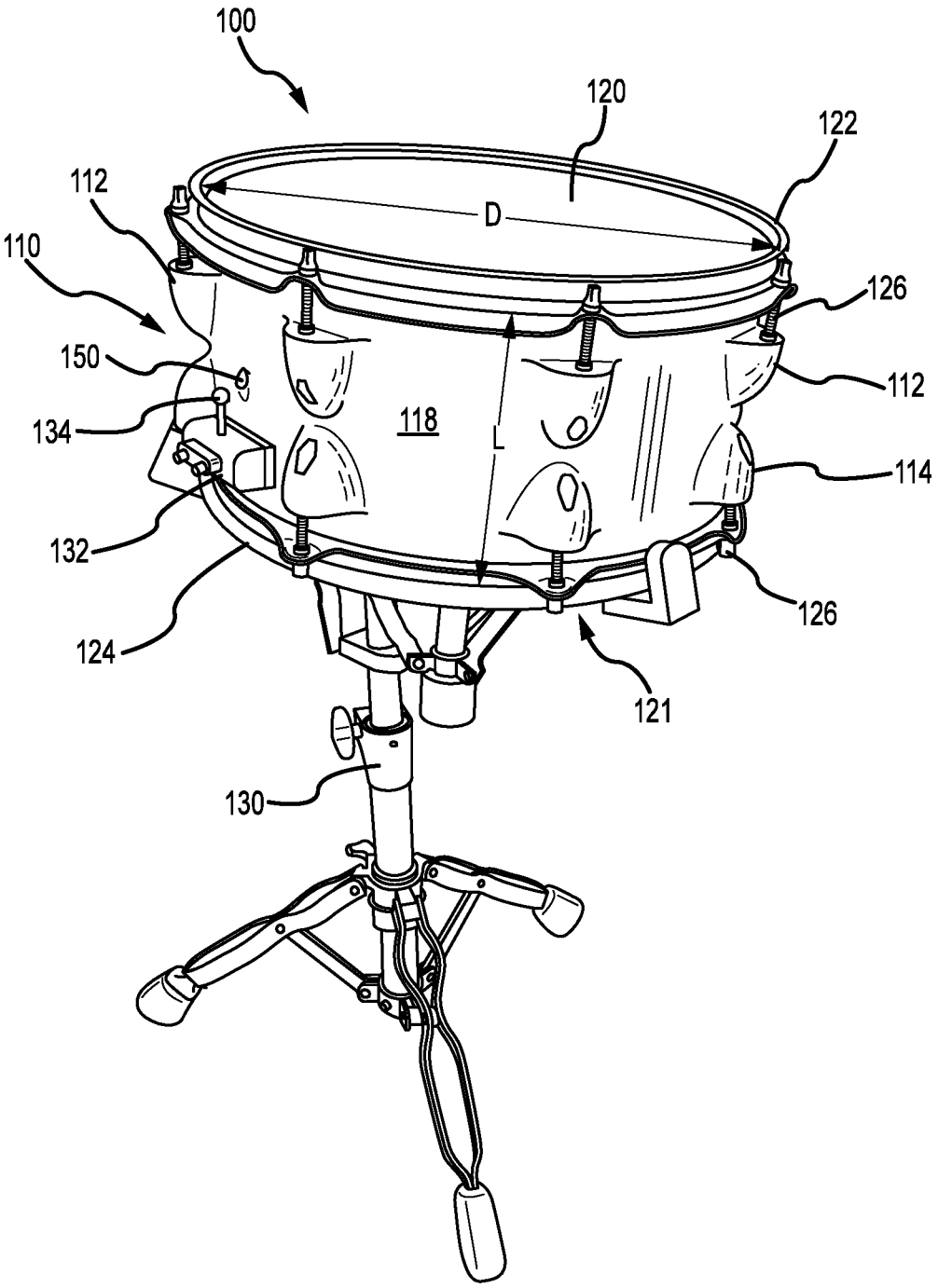
FIG. 1 is a perspective view of a representative drum system with an integrated drum body adapted for enhanced acoustic response.

FIG. 1 is a perspective view of a representative drum system 100, with an integrated drum body 110 adapted for enhanced acoustic response. As shown in FIG. 1, drum body 110 has a substantially cylindrical geometry, with a plurality of tension lugs or similar coupling structures 112 and 114 disposed about the outer perimeter, and one or more vent apertures or ports 150 extending through the side wall or shell 118 of drum body 110.

At least one drum head 120 can be attached across an opening in drum body 110, e.g., a top drum head 120 attached via a top rim (or top rim assembly) 122. Depending on configuration, a second drum head 121 can also be attached across the opposite (bottom) side of drum body 110, e.g., using bottom rim assembly 124. Alternatively, the geometry of drum body 110 may vary from cylindrical to frustoconical, or be generally hemispherical or oblate. Drum body 110 may also utilize a multiple-tapered design, and drum body 110 may have a range of tall, short, narrow and wider aspect ratios, as defined by the ratio of the height or length (L) of the drum body 110 along the side wall or shell 118, and the width or diameter (D) across the top or bottom opening.

Drum system 100 can typically be provided with an adjustable stand 130, in order to position the drum body 110 and head 120 at a desired height and orientation for performance. In snare drum embodiments, a tension assembly or snare strainer 132 can be mounted to the side wall 118 of the drum body 110, and configured to engage one or more snares (or similar acoustic accessories) across the bottom drum head 121, and to adjust the snare strainer 132 to produce a desired brightness and duration. A lever or release mechanism 134 can also be provided to selectively engage and disengage the snares.

Drum heads 120 and 121 are mechanically coupled to drum body 110 via the top and bottom hoop or rim assemblies 122 and 124, using tension rods or similar tension mechanisms (tensioners) 126 to attach the rims 122 and 124 to top and bottom lugs 112 and 114. Lugs 112 and 144 are distributed about the perimeter of the drum body side wall or shell 118, and tensioners 126 can be individually to tune drum heads 120 and 121 around the perimeter of each corresponding rim 122 and 124, so that the natural modes of oscillation match the frequency response of the resonant cavity defined by drum body 110. For creative purposes, some performers may also tune the drum head off resonance, or in any suitable combination of matched and unmatched frequency response, as adapted for a desired tonal response.

Drum heads 120 and 121 are coupled to openings at the opposite (top and bottom) ends of the drum body 110, defining a pair of acoustic membranes in communication with the resonant cavity inside the side wall or shell 118. As shown in FIG. 1, for example, tension mechanisms 126 are adapted to tighten the top and bottom rim assemblies 122 and 124 onto the upper and lower perimeter of the drum body side wall 118, respectively, stretching the drum heads 120 and 121 across the top and bottom openings. This forms an acoustic system in which the top and bottom drum heads 120, 121 are acoustically coupled through the cavity defined within the drum shell 118. The top drum head 120 is then struck by one or more drumsticks or mallets (or using a brushes, hammers or similar devices), exciting the resonant chamber and driving bottom drum head 121 into sympathetically vibrations. The bottom drum head 121 engages the snares when positioned by the snare assembly 140, producing a characteristic, multilayered sound.

Alternatively, the snare assembly 140 may be absent, with the acoustic response dominated by the coupling of drum heads 120 and 121 across the resonant chamber defined by drum body side wall 118. Drum body 110 may also have an open design, with or without one or both of the top and bottom drum heads 120, 121 (and corresponding rim assemblies 122, 124). In these examples, only upper lugs 112 may be present, and lower lugs 114 are not required. The aspect ratio and geometrical configuration of the drum body 110 and side wall 118 can also vary, as described above, in order to achieve a wide range of different performance characteristics.

In principle, the drum heads 120, 121 can take on a number of different geometric forms, but in practice almost all performance drum heads are substantially round, with resonant modes determined according to the Bessel functions. Suitable materials for drum heads 120, 121 include synthetic plastics and polymers such as KEVLAR and other aramid fibers, although animal skins are still used in traditional instrument manufacture. Similarly, rims 122 and 124 can be manufactured from steel and other metal alloys, or from laminated wood and other more traditional materials.

Lug design has a substantial effect on acoustic response of the drum body 110, and on the overall sound quality of drum system 100, because of the mechanical coupling between lugs 112, 114 and the resonant chamber defined within the shell 118. Conventional drum bodies, for example, can be made of laminated wood materials, high performance polymers, advanced plastics and composites, or metal materials, to which separate lug structures are coupled by a mechanical process. Simple plastic structures can also be used, as well as steel drum designs. Generally, however, the conventional approach to the problem of acoustic coupling between the drum body and the lugs has been to decrease the size and mass of the lug structures, and reduce the mechanical coupling to the shell (or to decouple the lugs altogether, at least as much as mechanically feasible, in a traditional design).

"Floating" shell designs are also known, e.g., where the lugs are mounted to one shell or side wall component of a two-shell system, sandwiching the single "virgin" shell between the lug-mounted (outer) shell and one or both of the rims. Certain types of metal materials may also provide a desired musical resonance, or larger, heavier lug structures can be used to change the tone of the instrument, in a way that may be attractive to some performers. Suitable metal materials include, but are not limited to, steel, nickel, copper, tin, brass, aluminum, titanium, and alloys thereof. In each of these examples, response depends on the strength of the mechanical and acoustic coupling between the lug bodies and the drum shell. Rather than attempting to decouple these structures, as in some prior art designs, the approach here is to join them together, modulating the acoustic response of the drum system by providing the drum shell and lug bodies in an integrated format.

This results in a unitary design of integrated drum body 110, in which lugs 112, 114 are formed together with the side wall or shell 118, using a substantially continuous or unitary material. In this approach, lug structures 112 and 114 are integrally formed with the side wall or shell 118 of the drum body 110, and provide an integral or inherent, closely-coupled contribution to the acoustic response of drum system 100. Rather than minimizing the acoustic and mechanical coupling between the lug structures 112, 114 and the drum body sidewall or shell 118, the size and mass distribution of the lug structures 112 and 114 can be selected to modulate the acoustic response, and the acoustic and mechanical coupling between the lug structures 112, 114 and the drum body side wall or shell 118 can be adapted to provide improved acoustic performance, with substantially better control of the desired sound quality.

Depending upon application, these goals can be achieved using a substantially continuous or integral material to define the elasticity and density distribution of the drum body side wall 118 and lug structures 112, 114, in order to modulate the frequency response of the resonant cavity defined by drum body 110, and obtain the desired acoustic response to a particular configuration of one or more drum heads 120, 121. In some of these embodiments, the integral material of the drum body may be substantially continuous and uniform (isometric and homogeneous).

Alternatively, advanced manufacturing techniques can be used to vary the material composition and density of drum body 110, in order to produce a desired mass distribution in the region of lugs 112, 114, as compared to side wall or shell 118, and to provide desired structural features in the perimeter regions of shell 118, where drum body 110 is coupled to one or more rim assemblies 122 and 124. Thus, the integrated design of drum body 110 can be configured to provide a combination of structural and mechanical advantages, substantially improving the performance of drum system 100 as described herein. Changes in material composition, elasticity, and other properties are also available with this design technique, as related to corresponding changes in density, acoustic response, and tone.

Figure 2:
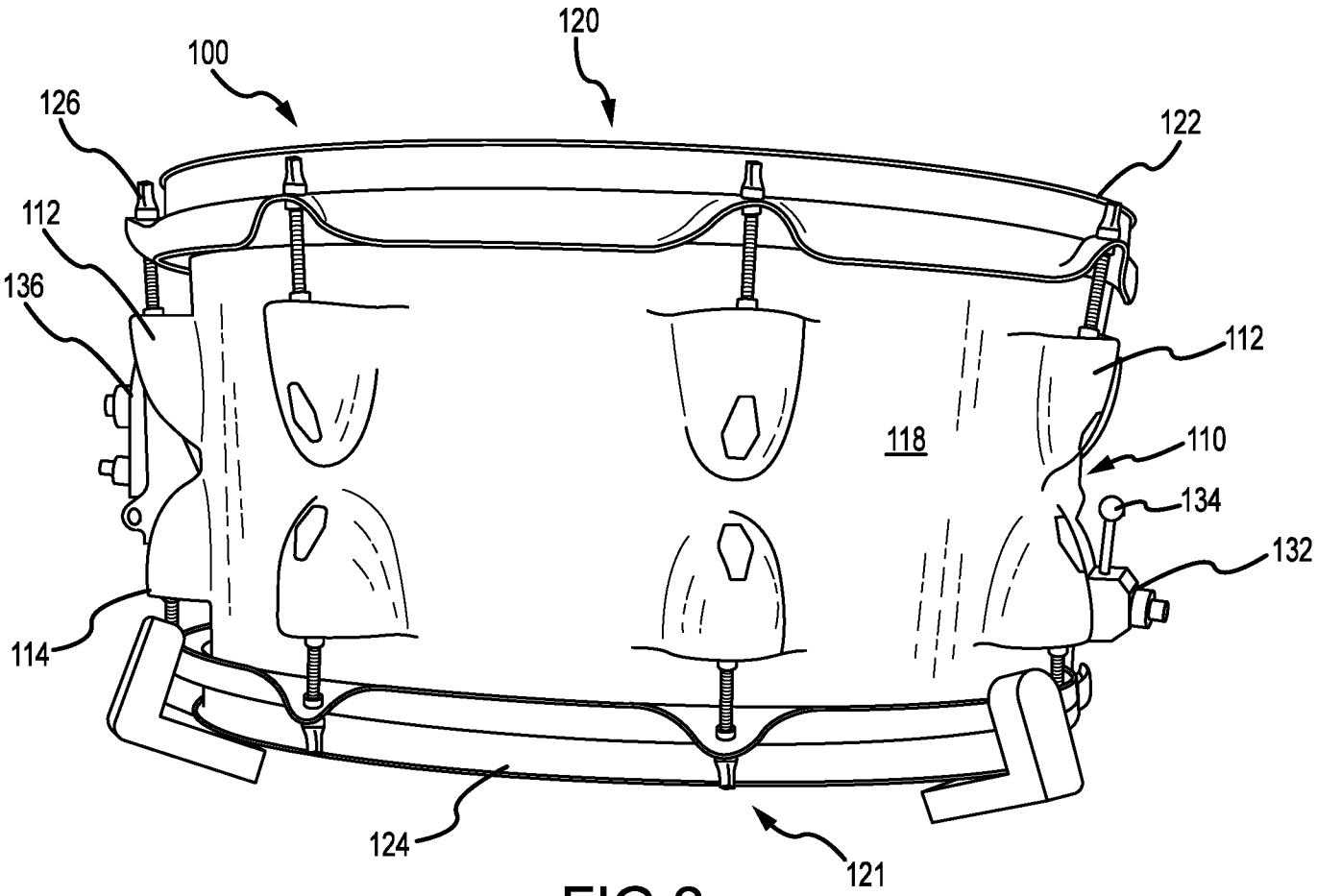
FIG. 2 is a side view of the drum system, showing the drum head attachment.

FIG. 2 is a side view of the drum system 100, showing the drum head attachment to the upper and lower perimeter of side wall 118 along the top and bottom rim assemblies 122 and 124, respectively. FIG. 2 shows the other side of the drum body from FIG. 1, in a generally opposite orientation with the snare strainer 132 mounted to the side wall 118 on the right side of drum body 110, and an anchor block or butt plate 136 on the left.

As shown in FIG. 2, a first plurality of tension rods or similar mechanisms (tensioners) 126 extend down from the top rim assembly 122 to a set of lugs 112 distributed about the upper perimeter of the drum body side wall 118, in order to secure the first drum head 120 to the top end of drum body 110, across the opening defined by the upper perimeter of the drum shell 118. A second plurality of tensioner rods 126 extend up from the bottom rim assembly 124 to another set of lugs 114 distributed about the lower perimeter of the drum body side wall 118, in order to secure the second drum head 121 to the bottom end of drum body 110, across the opening defined by the lower perimeter of the drum shell 118.

In contrast to conventional designs, drum body 110 has a unitary or integral construction in which side wall 118 and the top and bottom sets of lug structures 112, 114 are formed of a substantially continuous material. In this configuration, the material of drum body 110 can be adapted to improve the acoustic response of drum system 100 by selecting a desired mass and density distribution for the lug structures 112, 114 with respect to the drum body side wall or shell 118. The lug structures 112, 114 can also be formed integrally with the shell 118, in order to enhance the acoustic and mechanical coupling, rather than forming the side wall of one set of materials (e.g., laminated wood, metal or plastic), and then mechanically attaching separate lug components.

Suitable materials for drum body 110 include, but are not limited, to durable polymers and plastics, and composite materials including aramid fibers, graphite fibers, glass or silicon fibers, carbon fibers (or other structural components) embedded in a polymer or resin matrix, or a similar binder or filler material. Suitable methods of manufacture for drum body 110 include molding and volume printing. The material of drum body 110 may also be substantially uniform, or may have varying density and structural properties, for example to modulate the acoustic response of drum body 110 by controlling the size and density distribution of the side wall 118 and lug structures 112, 114, or to provide desired structural properties in the top and bottom perimeter regions of the side wall or shell 118, where drum body 110 is coupled to the top and bottom rim structures 122 and 124.

In particular embodiments, drum body 110 can be manufactured by stereolithography (SLA) or selective laser sintering (SLS), or other suitable 3D printing process, e.g., using a nylon-type polymer or other suitable powder-based (or fluid-based) volume printing material. A fusion jet printing process can also be used, e.g., by multi jet fusion (MJF) or a similar process for releasing a hardening agent into the print medium, using a precision controlled print head system. Other suitable additive manufacturing processes include, but are not limited to, binder jetting, directed energy deposition, material extrusion, material jetting, powder bed fusion, sheet lamination, and vat photopolymerization.

The particular material that is used to form drum body 110 can be selected to meet desired performance requirements for rigorous professional use, including durability and flexibility as well as rigidity, ultraviolet (UV) resistance and elasticity, across a range of playing environments including widely varying temperature and humidity extremes, and other operating conditions. In some of these applications, the material of drum body 110 may react to changes in temperature and humidity similarly to traditional wood materials, at least in part because the machines used to print drum body 110 are large enough to provide the desired substantially continuous structure across drum body side wall 118, and for forming lug structures 112, 114 of the same substantially continuous material. Whereas other materials may also be smoother or rougher, or have additional desired surface finish, color, and related aesthetic properties, they may also be more brittle, lack the desired dimensional stability or react poorly to UV light, or a both, yielding less desirable structural properties.

Other volume printing process machine systems may provide the desired material properties, but might not be large enough to print a suitable drum body 110 for full-sized embodiments of drum system 100, as described herein. There are also 3D printing and volume-based manufacturing system using the SLS process (or other suitable technique) that can print in metal and metal alloy materials, with material properties and cost depending on the particular metal or other material that is chosen. In some of these embodiments, drum body 110 is formed at least partially or substantially entirely of a suitable metal material or metal alloy. A mold or form process can also be used, either in a single-step manufacturing process or utilizing additional machine processing steps to provide the desired channel, cavity, and overhang features of lugs 112, 114, together with a suitable acoustic port 150 and other desired features the drum body side wall 118.

The number and spacing of the lug bodies or lug structures 112, 114 also varies. In one case, for example, there are up to eight top lugs 112 and eight bottom lugs 114 on each side of the drum body 110, evenly spaced directly above and below one another along the circumference of the drum body side wall 118. The number of lugs 112 and 114 may also be determined at least in part by the design of rim assemblies 122 and 124, which can be provided in standard configurations including, but not limited to, four, five, six, eight, ten and twelve (or more) tension rods 126, depending on the diameter of the drum opening (and the respective drum heads 120, 121), and user preference. Like other parameters, the lug number and spacing will also have resulting effects on tone and resonance. If preferred, the drum body could have up to ten or more lugs per side, or use another industry standard. The top and bottom lugs 112, 114 can also be offset along the drum body side wall 118, and the lug spacing can either be uniform, or different. More generally, the number, size, shape, position and spacing of the individual lugs 112 and 114 can vary, as defined along the integral drum body side wall or shell 118, and each of these design options are encompassed within the scope of the disclosure.

EXAMPLES

A suitable drum system or apparatus 100 can include a drum body 110 having a side wall 118 defining a resonant chamber inside the drum body 110, and a plurality of coupling structures or tension lug bodies 112, 114 disposed about the circumference of the drum body side wall 118. The coupling structures 112, 114 can be adapted for engaging a drum head 120 or 121 across an open end of the drum body 110, in acoustic communication with the resonant chamber.

In contrast to conventional designs, the drum body side wall 118 and coupling structures 112, 114 are formed of the same substantially continuous or integral material, defining an integral structure for the drum body 110.

Figure 3A:
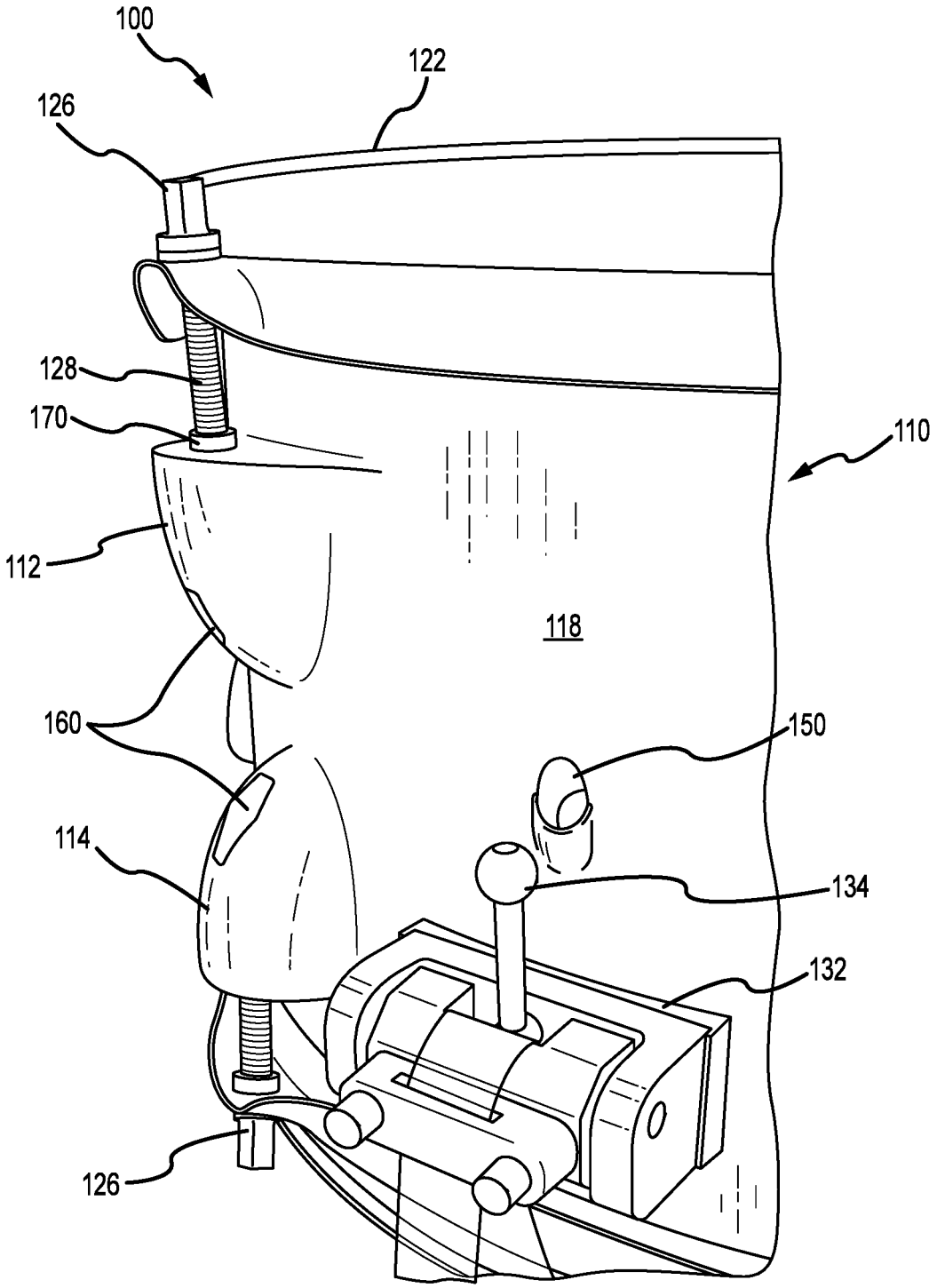
FIG. 3A is a detail view of the drum system and drum head attachment features.

FIG. 3A is a detail view of the drum system 100, illustrating drum head attachment features including upper and lower lug structures 112, 114 with channels 160 adapted to engage a threaded nut, lug or similar mechanical insert 170 adapted for coupling to the threaded section 128 of a respective tension rod 126. One or more vents or ports 150 can also be defined in the side wall 118 of the drum body 110.

As shown in FIG. 3A, a vertical channel 160 can be defined along each lug structure 112, 114, extending from a first or proximal end oriented toward the middle of drum body 110, to a firs or distal end oriented toward the upper or lower perimeter of the side wall or shell 118, respectively. Depending on embodiment, the proximal end of each channel 160 may define a hexagonal cross section or other suitable geometry adapted to receive the mechanical insert 170, and to seat the insert 170 within each lug structure 112, 114 for coupling to the engagement section 128 of the tension mechanism 126. For example, a nut or lug insert 170 can be inserted into the proximal end of each channel 160 and positioned with a threaded section extending past the distal end of the channel 160, for engagement of the tension rod 126 along the top or bottom surface the lug structure 112, 114, respectively.

The vent or port 150 is adapted to couple the resonance cavity defined inside drum shell 118 with the exterior (ambient) atmosphere, equalizing the average static pressure and providing for airflow between the interior and exterior of drum body 110. In contrast to conventional perpendicular vent designs, port 150 may extend at a skew (non-orthogonal) angle through side wall 118, with diameter adapted to further modulate the acoustic response of drum system 100 as described herein.

Figure 3B:
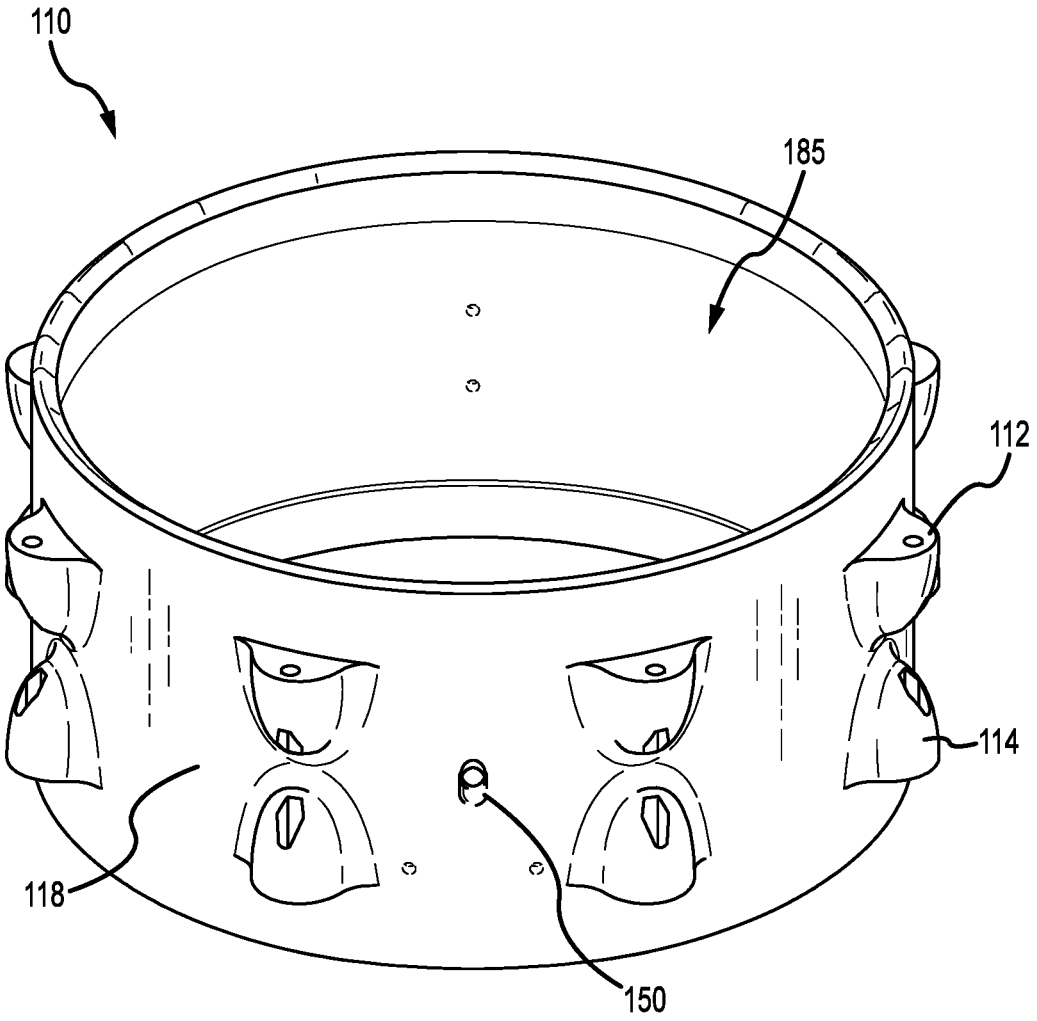
FIG. 3B is an isometric view of an integral drum body for the drum system.

FIG. 3B is an isometric view of a drum body 110 for the drum system 100. As shown in FIG. 3B, drum body 110 has a substantially cylindrical geometry, with a plurality of tension lugs or similar coupling structures 112 and 114 disposed about the outer perimeter, and one or more vent apertures or ports 150 extending through the side wall or shell 118 of drum body 110. Alternatively, the geometry of drum body 110 may vary from cylindrical to frustoconical, or be generally hemispherical or oblate. Drum body 110 may also utilize a multiple-tapered design. A resonant chamber 185 is defined by drum body side wall 118. The aspect ratio and geometrical configuration of the drum body 110 and side wall 118 can also vary in order to achieve a wide range of different performance characteristics, as described herein.

The size and mass distribution of the lug structures 112 and 114 can be selected to modulate the acoustic response of the resonant chamber 185, as described above. The acoustic and mechanical coupling between the lug structures 112, 114 and the drum body side wall or shell 118 can be adapted to provide improved acoustic performance, with substantially better control of the desired sound quality. In some of these embodiments, only upper lugs 112 may be present, and lower lugs 114 are not required. The upper and lower lug designations are also interchangeable, along with the related top and bottom features of drum body 110, without loss of generality.

The integral material of the drum body 110 can be substantially continuous and uniform (isometric and homogeneous), or the material composition and density of drum body 110 can be varied to produce a desired shell thickness and mass distribution for lugs 112, 114, and to provide desired reinforcement and bearing features along the upper and lower perimeters adjacent the open ends of shell 118. Changes in material composition, elasticity, and other properties are also available with this design technique, as related to corresponding changes in density, acoustic response, and tone of the resonant chamber 185.

Figure 4A:
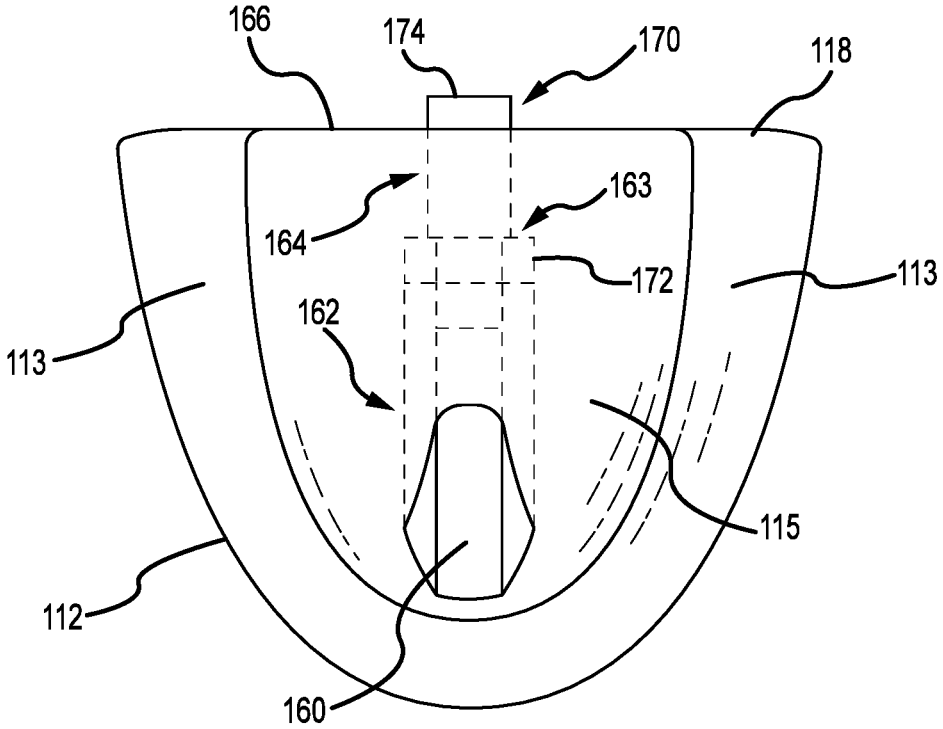
FIG. 4A is a front view of a representative lug structure, adapted for unitary construction with the integrated drum body.

FIG. 4A is a front view of a representative lug structure 112, adapted for unitary manufacture with the side wall 118 of integral drum body 110, as described herein. In this particular example, the lug structure 112 includes a flange portion 113 extending horizontally from either side of the main lug body 115 along the outer circumference of the drum body side wall or shell 118, forming an acoustic and mechanical coupling between lug 112 and drum body 110. The flange structure 113 can also extend vertically along the drum body side wall 118, e.g., from the lower or proximal portion of lug body 115 toward the middle portion of the drum body 110. Alternatively, the flange 113 may be absent, depending on desired design attributes and manufacturing capabilities. More generally, the main body 115 of each lug 112, 114 can take on a variety of suitable forms, while maintaining desired performance aspects of the percussion instrument embodied by drum system 100; that is, with an integral or unibody design of the drum body 110, to which one or more drum heads 120, 121 may be connected via corresponding hoops or rim assemblies 122, 124.

As shown in FIG. 4A, the proximal portion 162 of channel 160 is adapted accept a threaded nut, lug or other mechanical insert 170 for engagement with the coupling portion 128 of a corresponding tension mechanism 126. For example, the proximal end 162 of channel 160 may be adapted to receive an insert 170 with a nut section or collar 172 adapted for engagement with a stop 163 defined between the proximal and distal sections 162, 164 of the channel 160, within the body of lug 112.

To prevent rotation, the proximal section 162 and stop 163 can be provided with a suitable cross-sectional profile within channel 160, complementary to the lug insert 170. For example, the proximal section 162 of channel 160 may have a hexagonal configuration extending to stop 163, complementary to the shape of the nut section or collar 172 on insert 170 as shown. Alternatively, the proximal section 162 of channel 160 may be provided with a square, triangular, oblong, or star-shaped (TORX) type engagement, or other suitable arrangement adapted to engage insert 170 against stop 163, and prevent rotation within lug structure 112.

In additional embodiments, a suitable lug insert 170 can be threaded into or otherwise affixed within the lug structure 112. Alternatively, the channel 160 can be threaded in at least the distal portion 164, in order to engage with the coupling section 128 of the tension rod 126 directly, or via a lug insert or other mechanical fastener 170 fixed at distal end 164 of the channel 160.

The distal portion 164 of the channel 160 can thus be internally threaded, or adapted to engage the threaded barrel or engagement portion 174 of an insert 170. For example, the insert 170 can be positioned within the lug structure 112 by inserting the barrel section 174 into the proximal portion 162 of channel 160, and sliding the insert 170 along channel 160 until the collar 172 engages against the stop 163, with the barrel section 174 disposed in the distal section 164 of the channel 160. The insert 170 may be fully disposed fully within the channel 160, or the top end of the barrel 174 may extend above the top surface 166 of lug structure 112, in order to engage the threaded portion 128 of the tension rod or similar mechanical tensioning device 126 (e.g., as shown in FIG. 3A).

The tension lug bodies 115 are defined by the substantially continuous material forming each of the coupling structures 112, and can be adapted for coupling the drum head to the drum body along a perimeter of the drum body side wall, e.g., in tensioned engagement across the open end of the drum body as described herein. The flanges 113 can be defined by extending the substantially continuous material from one or more of the tension lug bodies 115 along an outer surface or circumference 156 of the drum body side wall 118, in acoustical and mechanical coupling with the drum body 110. For example, each flange 113 may define a substantially smooth and continuous curvature extending from the respective tension lug body 115 to the outer circumference 156 of the drum body side wall 118.

A plurality of mechanical inserts 170 can be disposed within the respective tension lug bodies 115, and adapted for engagement with a plurality of tension rods or other tension mechanisms configured for coupling a rim assembly to the open end of the drum body, adjacent the drum head. The tension rods can then be adjusted so that the drum head is disposed in tensioned engagement across the open end of the drum body, between the rim assembly and the perimeter of the drum body side wall 118.

For example, a longitudinal channel 160 may extend along each of the tension lug bodies 115, e.g., with a first (proximal) end 162 adapted to receive the mechanical insert 170 for engagement within the tension lug body 115, and a second (distal) end 164, adapted for the mechanical insert 170 to engage with one of the plurality of tension mechanisms. A stop 163 can be disposed within the tension lug body 115, between the first and second ends 162, 164 of the longitudinal channel 160.

The first end 162 of the longitudinal channel 160 can be adapted to receive and secure the mechanical insert 170 within the tension lug body 115, e.g., by engagement with the stop 163. The first end 162 of the longitudinal channel 160 can be further adapted to secure the mechanical insert 170 from rotation, e.g., by conformance with an outer geometry of the mechanical insert 170 in engagement with the stop 163. The first end 162 of the longitudinal channel 160 can also be adapted to secure the mechanical insert 170 from rotation by conforming the cross section of the channel 160 inside the first end 162 with the outer geometry of the mechanical insert 170, e.g., with the outer geometry of the nut or lug section 172 in engagement with the stop 163.

Alternatively, a heat set (e.g., metal) insert 170 can be used, in which heat is applied to the insert 170 or lug 112 (or both), until the integral drum material reaches a plastic phase transition temperature at which the insert 170 can be embedded into the lug body 115. Once the drum material cools, the nut portion 172 of the insert 170 is fixed against rotation within the lug 112, and provides a suitable threaded engagement at barrel section 174, adapted to receive a threaded tension rod 126. In these examples, the heat set insert 170 may be inserted into either the proximal end 162 or the distal end 164 of the channel 160, and then set against the stop 163, or the insert 170 may be disposed along the side of an open channel or similar receiving structure 160, for embedding insert 170 directly into the main body 115 of the lug 112.

Regardless of seating method, substantial stresses and strains may be imposed on the lug body 115, generated by engagement of the inserts 170 with the respective tension rods 126. Each insert 170 should thus be fixed within the lug structure 112 with sufficient strength to withstand tuning and pitch tensioning of the drum system in use as a precise musical instrument, over years or decades (or more) of service life, while maintaining structural integrity at least as well or better than a more traditional instrument design.

While FIG. 4A shows an upper set of lug structure 112 suitable for use with insert 170, the lower lug structures 114 may be similar or symmetric (e.g., with proximal and distal features having a reversed up/down orientation). The size and shape of the upper and lower sets of lug structures 112 and 114 may also vary, either with respect to one another, or among the individual lug structures 112 and 114 distributed about the upper and lower circumference of the drum body side wall 118.

Alternatively, the lower set of lug structures 114 may be absent, e.g., where the drum body 110 defines only a single open end. A single set of lug structures 112 may also be adapted for engaging two sets of tensioning mechanisms 126 to securing drum heads 120, 121 and rim assemblies 122, 124 to both ends of the drum body 110, e.g. using two oppositely-oriented mechanical inserts 170, or a single insert 170 with threaded couplings or other mechanical engagements at both ends.

Figure 4B:
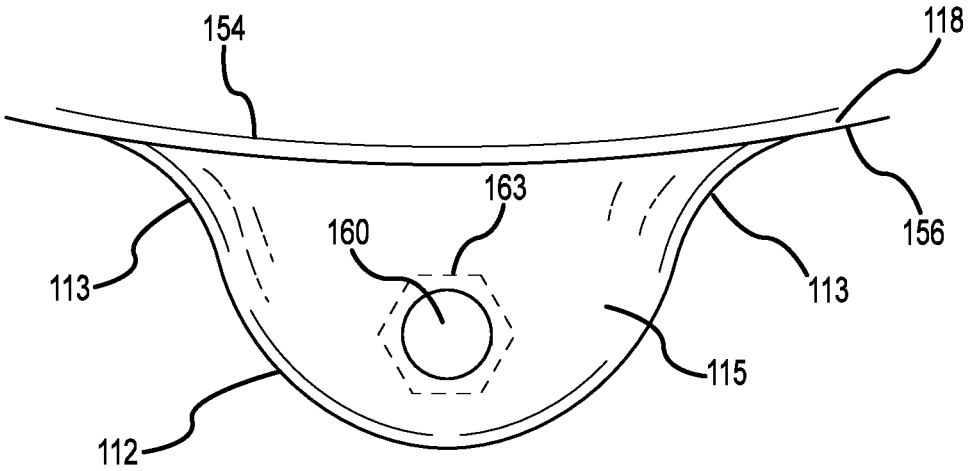
FIG. 4B is a top view of the lug structure in FIG. 4A.

FIG. 4B is a top view of the lug structure 112. Depending on embodiment, the flange structures 113 may be provided with a substantially smooth geometry having continuous curvature, so that the lug structure 112 blends smoothly into the drum body 110 from the main lug body 115 along the flange portion 113 to the outer perimeter or exterior surface 156 of the drum body side wall or shell 118. Alternatively, a suitable flange structure 113 may incorporate a discontinuous curvature or stepped geometry, in order to provide the desired acoustic mechanical coupling properties between the flange 113, lug body 115 and drum body side wall 118.

Figure 4C:
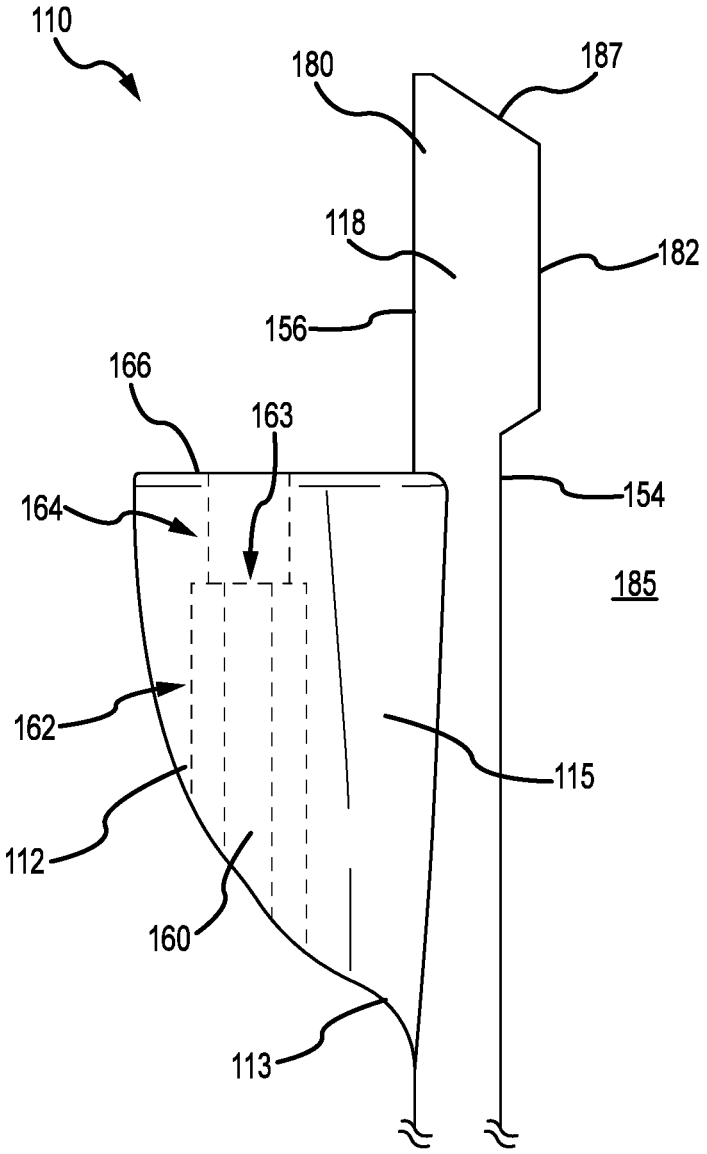
FIG. 4C is a section view of the lug structure and drum body side wall.

FIG. 4C is a section view of the lug structure 112 and drum body side wall 118. As shown in FIG. 4C, the top perimeter 180 of drum body side wall 118 can be beveled and provided with a suitable rim engagement or reinforcement structure 182 adapted for coupling to a drum head and rim assembly, for engagement of the drum head across the top opening in drum body 110, acoustically coupled to the resonant chamber 185 defined by side wall 118 inside drum body 110.

The lug structure 112 and reinforcement 182 can be provided in an integral configuration with the side wall 118 of drum body 110, in a unitary construction formed from a substantially continuous material as described herein. As shown in FIG. 4C, reinforcement structure 182 takes the form of an annular band extending along the upper perimeter 180 of drum body 110, on the inner surface of the drum body side wall 118, generally opposite the lug structure 112 on the outer surface of the drum body 110.

For example, a suitable perimeter reinforcement 182 can be formed by extending the substantially continuous material of the drum body 110 radially inward or outward from the drum body side wall 118, along or adjacent the perimeter 180, with the perimeter 180 defining an open end of the drum body 110 and resonant chamber 185. In some embodiments, the perimeter reinforcement 182 comprises an annular band of the substantially continuous material, extending radially from the perimeter 180 of the drum body side wall 118 adjacent the open end.

A beveled rim coupling or bearing edge 187 can defined along one or both of the perimeter 180 of drum body side wall 118 and the perimeter reinforcement 182, which extends from the side wall 118. The surface of the bearing edge surface 187 can be provided in any suitable shape, and at any suitable angle. Depending on embodiment, the bevel angle may vary from about 30 degrees to about 60 degrees, as measured with respect to the (vertical) side wall 118, for example about 45 degrees. The bevel configuration of the rim coupling 187 is also variable, e.g., in a range of standard, counter-cut, double angle, "roundover," or overhanging ("vintage") designs, or with reverse-angled outer and inner beveled surfaces, e.g., with a first angle (e.g., 30-60 degrees, or about 45 degrees) on the inner beveled surface of the bearing edge 187, and similar second angle on the outer beveled surface of the bearing edge 187. Each of these surfaces may extend at a suitable angle with respect to the corresponding adjacent horizontal or vertical surface, e.g., at about 10 degrees, about 15 degrees, about 30 degrees, about 45 degrees, about 60 degrees, about 75 degrees, about 80 degrees, or more or less (e.g., within a tolerance of about plus or minus five degrees).

The apex or corner feature defined at the intersection between the inner and outer angled surfaces can be sharp or rounded as well. The bearing edge 187 may have also have a substantially straight or perpendicular (at least partially flat or "dead flat") configuration, e.g., on either the inner or outer surface (or both). In each of these embodiments, the bearing surface 187 is variously adapted to secure a rim assembly to the open end of the drum body 110, with the drum head in tensioned engagement between the drum body and rim. Among these different possibilities and combinations, the tonal results vary with each choice in shape, and the configuration of the reinforcement 182 and bearing edge 187 can be selected accordingly.

Alternatively, reinforcement 182 may be formed along either the inner surface 154 or the outer surface 156 of the drum body side wall 118, and the width, thickness and beveling of reinforcement 182 and bearing edge 187 may vary depending on the desired structural and acoustic coupling to drum body 110. In additional embodiments, reinforcement structures 182, 184 may take the form of multiple annular ribs, vertical bars, scalloped features, and combinations thereof, or other structural elements suitable to reinforce the upper or lower perimeter of drum shell 118, or both, for attachment of one or more drum heads 120, 121 via the corresponding rim assemblies 122, 124. In further embodiments, drum body 110 can be provided in a design with a substantially uniform or vertical side wall 118, with or without reinforcement structures 182. Generally, the side wall 118 could also be designed similarly to the substantially vertical wall structure of a traditional wooden drum body, without distinct reinforcement structures 182 provided along either the inner surface 154 or outer surface 156.

Figure 5:
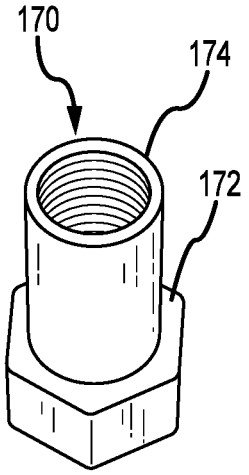
FIG. 5 is a perspective view of a representative mechanical insert for engagement with the lug structure.

FIG. 5 is a perspective view of a representative threaded nut mechanical fastener 170, suitable for insertion within the body of lug 112 via channel 160 as shown in FIGS. 4A-4C, by inserting the barrel section 174 into the proximal portion 162 of channel 160, and sliding the insert 170 along channel 160 until the collar 172 engages the stop 163, with the barrel section 174 disposed in the distal section 164 of channel 160. The insert 170 may be fully disposed fully within the channel 160, or the top end of the barrel 174 may extend above the top surface 166 of lug structure 112, in order to engage the threaded portion 128 of the tension rod or similar mechanical tensioning device 126 (e.g., as shown in FIG. 3A).

Figure 6:
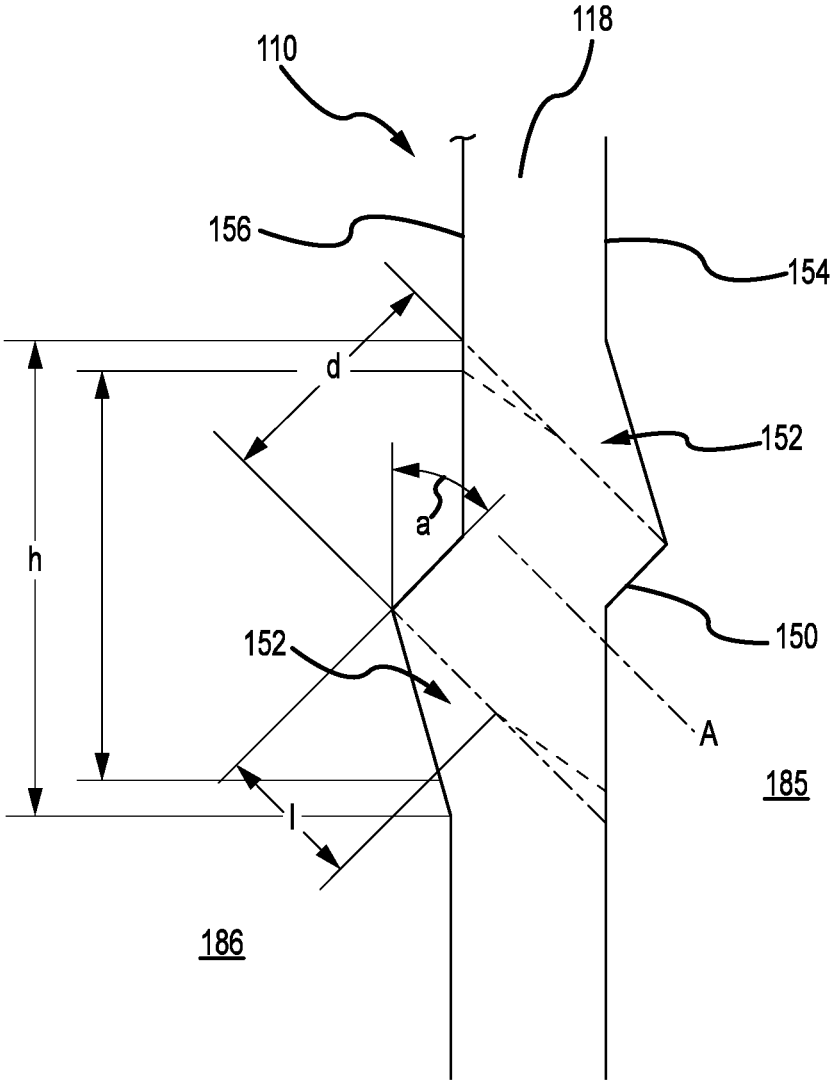
FIG. 6 is a section view of a representative vent or port structure in the drum body side wall.

FIG. 6 is a section view of a representative vent or port structure 150 defined in the drum body side wall 118 of an integrated drum body 110. As shown in FIG. 5, port 150 extends through side wall 118 at port angle (a), as defined between the (vertical) side wall 119 and a perpendicular taken across the diameter (d) of the port 150. Alternatively, a complementary port angle (a') can be defined between the side wall 118 and the longitudinal port axis A, perpendicular to the diameter (d).

In contrast to conventional designs, the port angle (a or a') is not necessarily 90 degrees, and port 150 may extend through the drum body side wall 118 at an acute or skew (non-orthogonal) angle, e.g., around 45 degrees, or between about 30 and about 60 degrees, or between about 20 degrees and about 70 degrees, or an another suitable acute or skew angle. Port 150 may also include one or more of port extensions or "ears" 152 protruding from the inner (interior) and outer (exterior) side wall surfaces 154 and 156 of the drum body side wall 118 (or both). The port extensions 152 extend or protrude from the inner and outer surface of the drum body side wall 118 generally along the longitudinal port axis A, increasing the axial extent or length of the port 150 to provide improved directional control of the airflow and modulation of the acoustic energy propagating through side wall 118 along port 150, between the resonant chamber 185 and the exterior 186 of the drum body side wall 118 along port axis A. Each of these surfaces may extend at a suitable angle with respect to the corresponding adjacent horizontal or vertical surface, e.g., at about 10 degrees, about 15 degrees, about 30 degrees, about 45 degrees, about 60 degrees, about 75 degrees, about 80 degrees, or more or less (e.g., within a tolerance of about plus or minus five degrees).

Depending on the angle (a) and the length (l) of the port extensions 152, the inner walls of the vent or port 150 may be substantially straight and generally parallel to the axis A (dashed lines), or include a change of slope (dotted lines). The overall height (h) of the port 150 can be defined across the bottom and top ends of the exterior and interior extensions 152, respectively, or across the bottom and top ends of the inner walls. In either case, the height (h) is typically larger than the diameter (that is, for port between zero and 90 degrees, exclusive), and may be somewhat greater for a straight-walled port 150 with longer extensions 152 (outer lines), than for inner walls with a change of slope, and shorter extensions 152 (inner lines).

A suitable acoustic port 150 may extend along a longitudinal axis A defined through the substantially continuous material of the drum body side wall 118, placing the acoustic port in pressure communication between the resonant chamber 185 defined within the drum body 110, and the drum exterior 186. As shown in FIG. 6, the longitudinal axis A of the acoustic port 150 defines an angle between about 30 and about 60 degrees with respect to the (vertical) orientation of the drum body side wall 118. Alternatively, the port axis may extend at another suitable angle with respect to the corresponding adjacent horizontal or vertical surface, e.g., at about 10 degrees, about 15 degrees, about 30 degrees, about 45 degrees, about 60 degrees, about 75 degrees, about 80-degrees, or more or less (e.g., within a tolerance of about plus or minus five degrees).

The substantially continuous material of the drum body 110 also protrudes from the drum body side wall 118 along the longitudinal axis A of the acoustic port 150, to define one or more port extensions 152. For example, the extension 152 may define an inner surface or wall of the acoustic port 150 extending radially inward or radially outward from the drum body side wall 118, or both, in either direction along the longitudinal axis A.

Figure 7:
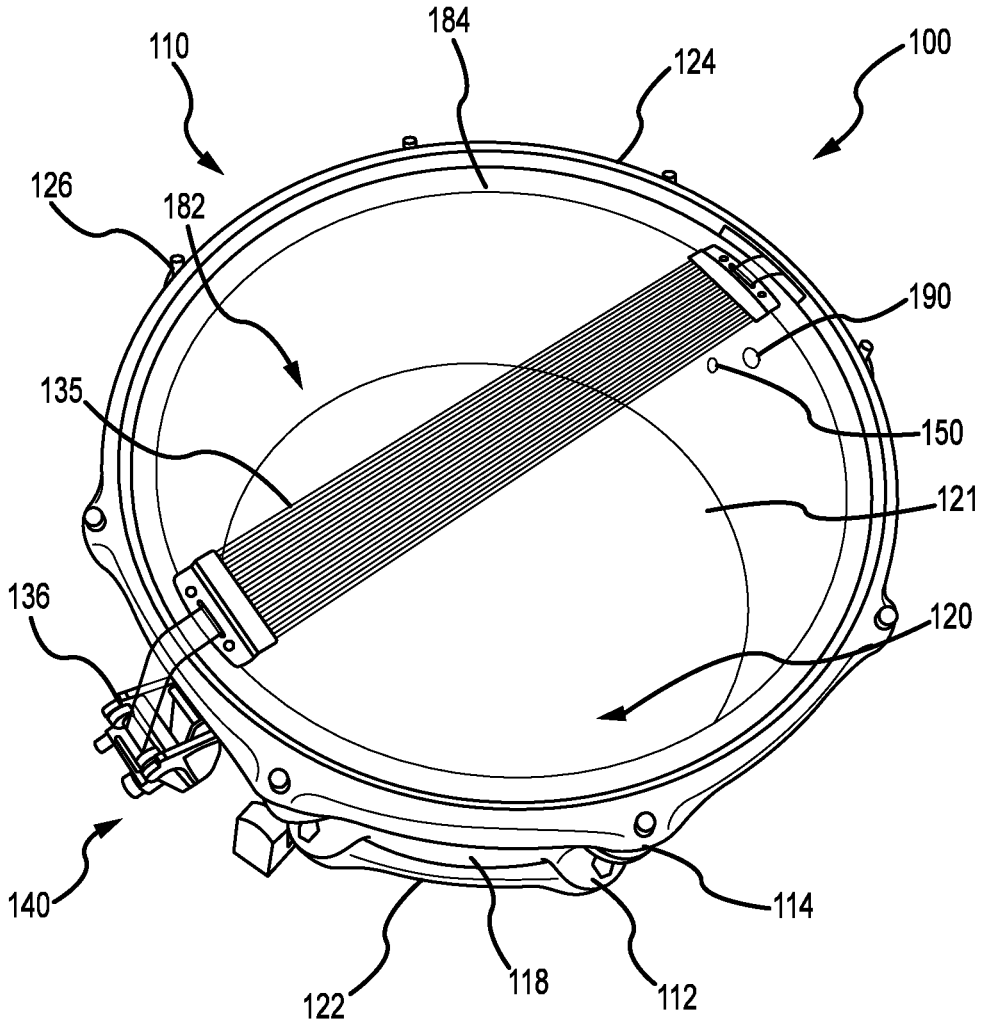
FIG. 7 is a bottom view of the drum system, showing the reinforced perimeters of the drum body side wall.

FIG. 7 is a bottom view of drum system 100, with upper and lower drum shell reinforcements 182, 184. Reinforcements 182, 184 are configured to provide structural support to the drum body side wall or shell 118, e.g., for attachment of the top and bottom rim assemblies 122, 124, and in order to couple drum heads 120, 121 to drum body 110.

As shown in FIG. 7, reinforcement structures 182, 184 are visible through the transparent surface of the bottom drum head 121, stretched across the lower opening in drum body 110, adjacent snares 125. In this particular example, reinforcements 182, 184 take the form of annular bands disposed on the inner surface of the drum body 110, extending along the upper and lower perimeter of the drum body side wall or shell 118. One or more thru-mounts 190 are provided for the snare tensioner and butt plate 136 or similar snare assembly configured to dispose snares 135 in acoustical contact with bottom drum head 121. More generally, while thru-mounts 190 may refer to the mounting holes themselves, in other embodiments mounts 190 may include mounting lugs, tabs, slots, and additional butt and throw-off mounting structures, with any suitable combination of hole and feature size, spacing and orientation, based on the desired mounting configuration.

Lugs 112, 114 and structural reinforcements 182, 184 can be provided in an integral configuration with the side wall 118 of drum body 110, formed from a substantially continuous or unitary material. Depending on configuration, the reinforcements 182, 184 can be disposed generally above and below the upper and lower lug structures 112, 114 and configured to reinforce the upper and lower perimeter of the drum shell 118 for attachment of the top and bottom drum heads 120, 121 via top and bottom rim assemblies 122, 124. Alternatively, the reinforcement may be disposed generally opposite the lugs 112, 144 across the drum body side wall 118, and the reinforcement geometry may vary as described above.

In this example, the drum body side wall 118 defines first and second open ends at opposite sides of the drum body 110 (e.g., at the top and bottom perimeters of the side wall 118). The coupling structures or lug bodies 112, 114 are adapted for engaging respective sets of tension rods 126 to secure first and second rim assemblies 122, 124 to the first and second open ends of the drum body 110, respectively, with the drum heads 120, 121 in tensioned engagement between the respective rims 122, 124 coupled to the upper and lower perimeters of the drum body side wall or shell 118, as defined along the corresponding reinforcement structures 182, 184.

The coupling structures comprise first and second sets of tension lug bodies 112, 114, formed of the same substantially continuous material as the drum shell 118, and disposed along upper and lower perimeters of the drum body side wall 118 proximate the first and second open ends of the drum body, respectively. The first and second sets of lug bodies 112, 114 are adapted for engaging the respective sets of tension rods 126, in order to secure the first and second drum heads 120, 121 and rim assemblies 122, 124.

One or more through-mounts 190 can be adapted for mounting for a snare assembly 140 to the drum body side wall 118. The snare assembly 140 is configured to engage one or more snares 135 across the second (bottom) drum head 121, in acoustic communication with the top drum head 120 via the resonant cavity inside the drum body side wall or shell 118.

For example the through-mount 190 may include first and second sets of through holes adapted for mounting a snare strainer 132 and butt plate or anchor block 136 on generally opposite sides of the drum body side wall, the butt plate 136 configured for extending the snares across the second drum head and the snare strainer 132 configured for engaging the snares therewith.

Figure 8A:
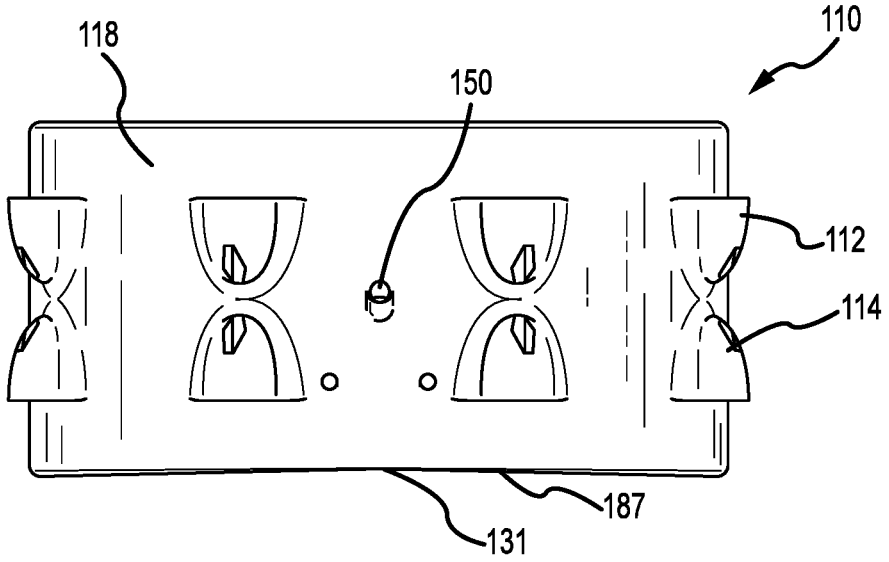
FIG. 8A is a front elevation view of the drum body, showing a first snare bed.
Figure 8B:
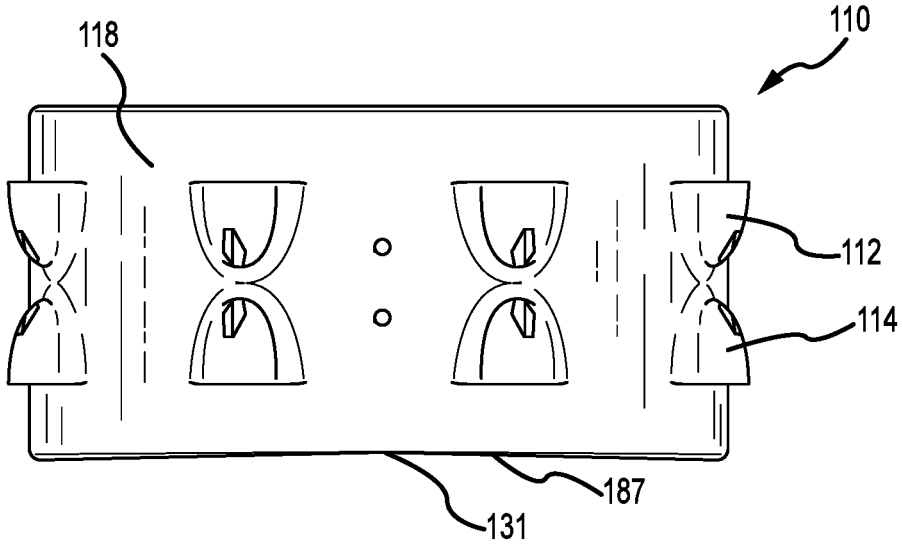
FIG. 8B is a rear elevation view of the drum body, showing a second snare bed.

FIG. 8A is a front elevation view of the drum body 110, showing a first (front) snare bed 131. FIG. 8B is a rear elevation view of the drum body 110, showing a second (rear) snare bed 131.

The snare beds 131 each form a recess within the bottom bearing edge 187 and are positioned opposite each other on the drum body 110, as shown by FIGS. 8A and 8B. The snare beds 131 are typically positioned in between two sets of lugs; however, other configurations are possible. The snare beds 131 are adapted for the bottom drum head 121 to form a convex shape across the plane of snare wire contact surface, leading to direct, uniform contact between the snare wires and the bottom drum head 121.

The natural state of the snare wires without the snare beds 131 is typically a curved shape due to the position of the snare wires relative to the through-mount 190 and the butt plate 136 (See FIG. 7). Snare beds 131 are adapted for the snare wires to sit more suitably across the bottom drum head 121, in tensioned engagement across the open end of the drum body 110. The shape and positioning of the snare beds 131 also allows for improved operation and response of the snare wires. Without suitably configured snare beds 131, the snare wires would not necessarily respond with the same sensitivity to player performance, nor would the snare wires always operate as expected or intended when mechanical adjustments are made by a user; e.g., to engage or disengage the snare wires, or to adjust the snare tension.

The configuration of snare beds 131 may vary based on the material composition and forming process of the bearing edge 187. For example, in traditional wood shell manufacture, the snare beds 131 can be formed by numerous methods such as routing by hand or by jig, cutting by a hand saw or band saw, or filing and hand-sanding. As another example, for a metal bearing edge, the snare beds 131 can be shaped into the bearing edge by bending or hammering.

The snare beds 131 can also vary in width, depth, shape and angle. For width, typical snare beds can range anywhere from 1 inch (25.4 mm) or less up to half of the width of the bearing edge. For depth, typical snare beds can range anywhere from 1 mm or less to ¼ inch (6.35 mm) or more. In some examples, the snare beds 131 can include gradual sloped features, while in other examples, the snare beds 131 can be defined along substantially sharper angular edges.

Figure 8C:
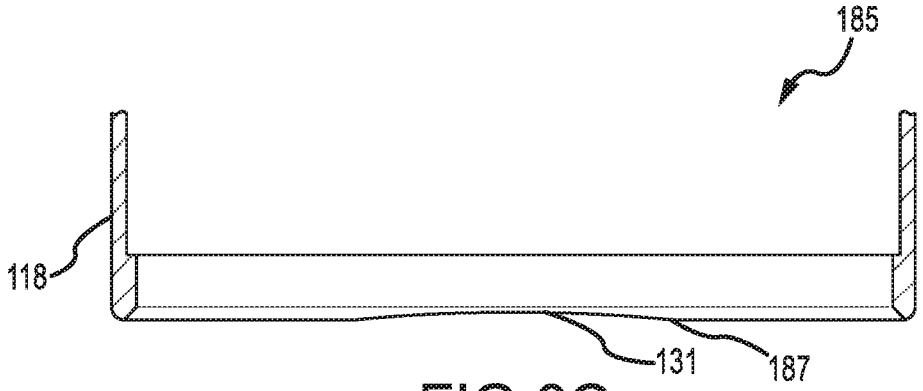
FIG. 8C is a section view of the drum body, illustrating a representative snare bed.
Figure 8D:
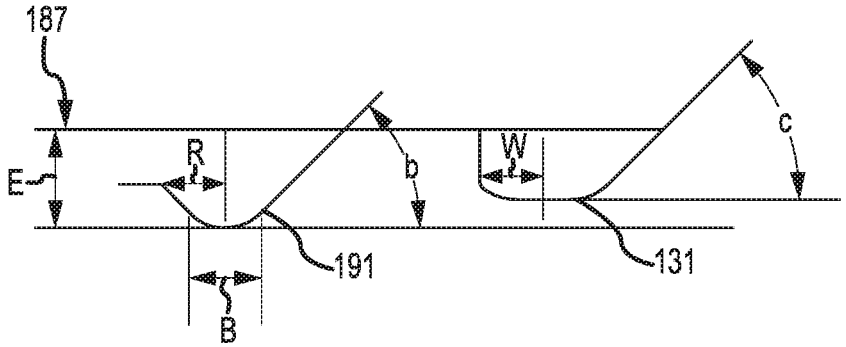
FIG. 8D is a detail view of the bearing edge, showing structure of the snare bed.

FIG. 8C is a section view of the drum body 110, showing the configuration of a representative snare bed 131. FIG. 8D is a detail view of the bearing edge 187, in which the snare bed 131 is formed or defined.

FIG. 8C shows the snare bed 131 defined along the bottom bearing edge 187 of the drum body 110. The measurements on the left side of FIG. 8D depict typical dimensions for the bearing edge 187 without a snare bed 131. The left side of this figure also includes a typical head ridge 191 within the bearing edge 187, to show an example of how the head ridge structure 191 can compare to the shape of an exemplary snare bed 131. Other shapes and sizes for the head ridge 191 are also contemplated in relation to the shape of the snare bed 131. The drum head (e.g., a top or bottom drum head 120 or 121) is stretched over and couples to the head ridge 191. In the example shown in FIG. 8D, the head ridge 191 is the same depth as the bearing edge depth (E). In one example, the ridge angle (b) is a 45 degree angle; however, other angles are contemplated, for example between 40 degrees and 50 degrees, or between 30 degrees and 60 degrees, or more or less. The base length (B) and the radius (R) of the head ridge 191 can also vary in dimension.

The right side of FIG. 8D depicts typical measurements of a suitable snare bed 131 as it relates to the bearing edge 187 and the head ridge 191 defined along the perimeter of a drum body 110. As mentioned previously, the snare bed 131 can vary in width, depth, shape, and angle. In one example, the snare bed angle (c) is a 45 degree angle, matching the ridge angle (b). However, numerous snare bed angles (c) are contemplated, similar to the ridge angle (b), creating gradual, angular, or other snare bed shapes. Other suitable angles include about 10 degrees, about 15 degrees, about 30 degrees, about 45 degrees, about 60 degrees, about 75 degrees, about 80-degrees, or more or less (e.g., within a tolerance of about plus or minus five degrees). The radius (W) of the snare bed 131 can also vary in measurement. In one example, the radius (W) of the snare bed 131 is the same measurement as the radius (R) of the head ridge 191, and in other embodiments these dimensions vary.

Percussion Instruments and Methods of Manufacture

A suitable drum system or percussion instrument 100 can thus be provided, e.g., comprising one or more of a drum body 110 formed of an integral material, the drum body 110 having a drum shell defining a side wall 118, a resonant chamber 185 defined within the drum shell 118, and a plurality of tension lug bodies 112, 114 or 115 formed of the integral material. The tension lug bodies 112, 114 or 115 may be disposed about a circumference of the drum body side wall 118, and adapted for coupling a drum head 120 or 121 across an open end of the drum shell 118, as defined along a perimeter 180 of the drum body side wall 118, with the drum head 120 or 121 in acoustic communication with the resonant chamber 185.

One or more flanges 113 can formed of the integral material, extending from the respective tension lug bodies 115 in acoustic and mechanical coupling with an outer surface 156 of the drum shell 118. For example, the flanges 113 can define a substantially smooth and continuous curvature between the lug body 115 and the outer surface 156 of the drum shell 118, or the flange structure can be stepped or discontinuous.

A plurality of tension rods 126 can be engaged with the tension lug bodies 112, 114, 115 disposed about the circumference or outer surface 156 of the drum body side wall 118, with the tension rods 126 adapted to couple the drum head 120, 121 in tensioned engagement across the open end of the drum shell 118. A rim assembly 122, 124 can be coupled to the tension rods 126 along the perimeter 180 of the drum body side wall 118, with the rim assembly 122, 124 adapted to couple the drum head 120, 121 across the open end of the drum shell 118.

A perimeter reinforcement 182 may be comprised of the integral material, e.g., extending radially inward or outward from the inner surface 154 or outer surface 156 of the drum shell 118, along the perimeter 180 of the drum body side wall 118 adjacent the rim assembly 122, 124. A beveled surface or other rim coupling or bearing edge 187 can extend along or adjacent the perimeter reinforcement 182, with the bearing edge 187 adapted to secure the drum head 120 or 121 in tensioned engagement along the perimeter 180 of the drum body side wall 118, e.g., between the rim assembly 120, 122 and the bearing edge 187.

A plurality of mechanical inserts 170 may be disposed in the tension lug bodies 112, 114 or 115, with the mechanical inserts 170 configured for engagement with the respective tension rods 126 to couple the drum head 120, 121 across the open end of the drum shell 118. For example, the mechanical inserts 170 can be secured within longitudinal channels 160 extending along the respective tension lug bodies 112, 114, 115.

Each of the longitudinal channels 160 can have a first end or proximal section 162 adapted for receiving a respective mechanical insert 170, e.g., in rotationally fixed engagement against a stop 163, and a second end or distal section 164 adapted for engagement of the mechanical insert 170 with a respective tension rod 126. Each of the mechanical inserts 170 can have a first (e.g., nut or lug) portion 172 adapted for conformance with a cross-sectional geometry of the respective longitudinal channel 160, e.g., in the first end 162, in rotationally fixed engagement against the stop 163, and a second (e.g., barrel or coupling) portion 174 adapted for threaded engagement with the respective tension rod 126.

One or more acoustic ports 150 may extend through the drum shell 118 along a longitudinal axis A, e.g., where the integral material protrudes from the drum shell 118 along the longitudinal axis A to define an extension 152 of the acoustic port 150. The port extensions 152 can protrude from either the inner or outer surface 154, 156 of the drum shell 118, e.g., along a longitudinal axis A defining a skew or acute an angle with respect to the drum shell 118, for example between about 20 degrees and about 70 degrees, between about 30 and about 60 degrees, between about 40 degrees and about 50 degrees, or at about 45 degrees with respect to the drum shell.

In some percussion instruments, drum body side wall 118 defines first and second open ends at opposite sides of the drum body 110, e.g., with the coupling structures 112, 114 adapted for engaging two different respective sets of tension rods 126 to secure the first and second rim assemblies 122 and 124 to the first and second open ends of the drum body 110, with respective first and second drum heads 120 and 121 in tensioned engagement between the rim assemblies 112, 124 and the rim couplings or bearing edges 187 along the upper and lower perimeter of the drum shell 118. One or more through-mounts 190 can also adapted for mounting for a snare assembly 140 to the drum body side wall 118, where the snare assembly 140 is configured to engage one or more snare components 135 across the second drum head 121, in acoustic communication with the first drum head 120 via the resonant chamber 185 defined inside the drum shell 118.

Depending on desired sound quality and performance characteristics, the body 110 of the percussion instrument 100 can be formed of a substantially continuous or integral material, for example including a continuous polymer or matrix material. The substantially continuous or integral material may also include reinforcing fiber materials, for example a composite material with a polymer matrix or binding material combined with aramid fibers. As one example, the material may include a wood polylactic acid (PLA) material (e.g., in a powder or filament form).

Suitable methods of manufacture of a drum system or percussion instrument include one or more steps of forming a drum body of a substantially continuous material, e.g., with the drum body having a drum shell defining a resonant chamber, and forming a plurality of tension lug bodies of the substantially continuous material, with the tension lug bodies disposed about a circumference of the drum shell, in acoustic and mechanical coupling with the drum body.

The tension lug bodies can be adapted for engaging a drum head across an open end of the drum shell, e.g., as defined along a perimeter of the drum body side wall, in acoustic communication with the resonant chamber. Flanges can be formed of the substantially continuous material, e.g., extending from one or more of the tension lug bodies along an outer surface of the drum shell, in acoustic and mechanical coupling with the outer surface of the drum body side wall.

In percussion instrument embodiments, the method can include engaging a plurality of tension rods with the tension lug bodies disposed about the circumference of the drum shell, coupling the tension rods with a rim assembly, and adjusting the tension rods to couple the drum head across the open end of the drum shell. This technique can be used to dispose the drum head in tensioned engagement between the rim assembly and the drum body, along the circumference of the drum shell.

A perimeter reinforcement can be formed of the substantially continuous material, e.g., extending from the drum shell along the perimeter defining the open end. A rim coupling or beveled engagement surface can also be formed of the substantially continuous material, e.g., extending along one or both of the perimeter of the drum shell and the perimeter reinforcement. The rim coupling can be adapted to couple a rim assembly in compressive engagement with the open end of the drum body, e.g., with the drum head disposed between the rim assembly and the rim coupling surface.

A plurality of mechanical inserts can be disposed in the tension lug bodies, with the mechanical inserts adapted to engage a plurality of tension rods to couple the drum head across the open end of the drum shell. For example, the mechanical inserts may be received or inserted into longitudinal channels defined along the tension lug bodies and seated against a stop or shoulder structure defined in or along the channel, with the mechanical inserts disposed in rotationally fixed engagement within the respective tension lug bodies for coupling the tension rods in threaded engagement with the respective mechanical inserts.

One or more acoustic ports can be defined through the drum shell and extend along a longitudinal axis, e.g., where the substantially continuous material protrudes from the drum shell along the longitudinal axis to define one or more extensions of the acoustic port on the inner or outer surfaces of the drum shell. The angle of the longitudinal axis can be between about 20 and about 70 degrees with respect to the drum shell, or otherwise as described herein.

Suitable method of making percussion instruments can also include defining first and second open ends of a drum shell, e.g., at opposite (top and bottom) sides of the drum body, and adapting the coupling structures for engaging respective sets of tension rods to secure first and second rim assemblies to the first and second open ends of the drum body. This places the first and second drum heads in tensioned engagement between the respective rim assemblies and the perimeter of the drum shell at each of the open ends.

Suitable methods of forming the drum body and tension lug include volume printing the substantially continuous material, e.g., using an SLS process where the substantially continuous material comprises a polymer matrix, fiber reinforcement, or a combination thereof. Alternatively, a metal or metal alloy may be used. As another example, a composite polymer material, such as, for example, wood PLA material, may be used. Thickness of the drum shell can be adjusted to change the mass distribution of the drum body, in order to tune the acoustic response of the resonant chamber. Similarly, the mass of the tension lug bodies can also be adjusted for tuning the acoustic response.

In additional embodiments, the drum system 100 may include an integral drum body 110 with lug structures 112 or 114 (or both) adapted for coupling a drum head 120, 121 to one or more open ends of the drum body 110, e.g., using a suitable rim assembly 122, 124 coupled to the lug structures 112, 114 via a plurality of tension rods 126. The drum body side wall or shell 118 is integral to the drum body 110, and formed of a same, substantially continuous or unitary material with the lug structures 112, 114.

A snare strainer 132 and tensioner lever 134 can be provide to engage one or more snares 135 across one of the drum heads, e.g., bottom drum head 121. An air vent or port 150 can be adapted for pressure communication between the resonant chamber or inner cavity 185 on the inside of the drum shell 118, and the drum exterior 186 on the outside of the shell 118. One or more port extensions or "ears" 152 can be provided on either the inner surface 154 or outer surface 156 of the drum shell 118 (or both), and configured to extend the port 150 along an axis A defined through the drum shell 118.

Each lug 112, 114 can be provided with a channel 160 for engaging one or more such drum heads 120, 121 across the open end or ends of the drum body 110, e.g., using a threaded channel 160 or a mechanical insert 170 disposed inside each channel 160 to couple the lugs 112, 114 to the rim assemblies or hoops 122, 124 via a plurality of tension rods or threaded fasteners 126.

The channels 160 thus enable tensioned engagement of the drum heads 120, 121 to one or both ends of the side wall 118 of the drum body 110. Depending on embodiment, each channel 160 may extend from a proximal end 162 adapted for insertion of the mechanical insert 170 to a distal end 164 adapted for engagement of the insert 170 with a respective tension rod or similar mechanical tension element 126. A stop 163 can be disposed along each channel 160 between the proximal end 162 and the distal end 164, and configured for seating the insert 170 within the respective lug 112, 114, e.g. with a nut section 172 adapted for fixing the insert 170 against rotation and a barrel section 174 extending to or from the top (or bottom) surface 166 of each respective lug structure 112 (or 114).

The design of each lug structure 112, 114 may vary, along with the vertical alignment or offset of top and bottom lugs 112 and 114, and the spacing between adjacent top lugs 112 and adjacent bottom lugs 114. Each channel 160 is defined in a main lug body 115, formed integrally of a substantially continuous material with the drum shell 118. Optional flanges 113 may extend from the main lug body 115 along the outer surface 156 of drum shell 118, in acoustic and mechanical coupling therewith. Depending on design, the flanges 113 can be adapted to modulate the tonal response of the drum system 100 by channeling vibrational (acoustic) energy between the drum shell 118 and the lug structures 112, 114, or flanges 113 may be absent, with the acoustic and vibrational coupling between lug structures 112, 114 and the drum shell 118 defined along the main body 115.

EXAMPLES

In various examples and embodiments, a drum apparatus according to the disclosure comprises a drum body having a side wall defining a resonant chamber; and a plurality of coupling structures disposed about a circumference of the drum body side wall, the coupling structures adapted for engaging a drum head across an open end of the drum body, in acoustic communication with the resonant chamber; wherein the drum body side wall and coupling structures are formed of a substantially continuous material defining an integral structure of the drum body.

A tension lug body can be defined by the substantially continuous material forming each of the coupling structures, the tension lug body adapted for coupling the drum head to the drum body along a perimeter of the drum body side wall, in tensioned engagement across the open end of the drum body. A flange can be defined by the substantially continuous material extending from one or more of the tension lug bodies along an outer surface of the drum body side wall, in acoustical and mechanical coupling therewith. The flange may define a substantially smooth and continuous curvature extending from the respective tension lug body to the outer surface of the drum body side wall.

A plurality of mechanical inserts can be disposed within the tension lug bodies, the mechanical inserts adapted for engagement with a plurality of tension mechanisms configured for coupling a rim assembly to the open end of the drum body, adjacent the drum head. The drum head can be disposed in tensioned engagement across the open end of the drum body, between the rim assembly and the perimeter of the drum body side wall. A longitudinal channel may extend along each of the tension lug bodies, the longitudinal channel having a first end adapted to receive the mechanical insert for engagement within the tension lug body and a second end adapted for the mechanical insert to engage with one of the plurality of tension mechanisms. A stop disposed within the tension lug body between the first and second ends of the longitudinal channel, wherein the first end of the longitudinal channel is adapted to secure the mechanical insert within the tension lug body by engagement with the stop. The first end of the longitudinal channel can be further adapted to secure the mechanical insert from rotation by conformance with an outer geometry of the mechanical insert in engagement with the stop.

A perimeter reinforcement may be comprised of the substantially continuous material, e.g., extending from the drum body side wall along a perimeter thereof, the perimeter defining the open end of the drum body. For example, the perimeter reinforcement can comprise an annular band of the substantially continuous material extending radially from the perimeter of the drum body side wall adjacent the open end of the drum body. A rim coupling or bearing edge can be defined along one or both of the perimeter of drum body side wall and the perimeter reinforcement extending therefrom, the rim coupling or bearing edge adapted to secure a rim assembly to the open end of the drum body with the drum head in tensioned engagement therebetween. One or more snare beds can be defined along the bearing edge.

An acoustic port can be provided, e.g., extending along a longitudinal axis defined through the substantially continuous material of the drum body side wall, the acoustic port in pressure communication between the resonant chamber defined within the drum body and an exterior thereof. The substantially continuous material may protrude from the drum body side wall along the longitudinal axis of the acoustic port to define an extension thereof. The extension can define an inner surface of the acoustic port extending radially inward or radially outward from the drum body side wall, or both, along the longitudinal axis. The longitudinal axis of the acoustic port may define an angle between about 30 and about 60 degrees with respect to the drum body side wall.

In an alternative embodiment, a separate drum port component independent of the drum body can be provided, defining the acoustic port or vent, and configured to engage with the drum body side wall. An outer surface of the separate component may protrude from the separate component along the longitudinal axis of the acoustic port to define an extension thereof. The extension can define an inner surface of the acoustic port extending radially inward or radially outward from the separate component, or both, along the longitudinal axis. The longitudinal axis of the acoustic port may define an angle between about 30 and about 60 degrees with respect to the separate component.

The separate component may be a single piece or it may be two or more pieces that link together. In one embodiment, the single piece may be formed from a metal plate, e.g., where the metal plate defines the acoustic port and has an outer portion that protrudes from the metal plate along the longitudinal axis of the acoustic port to define an extension thereof. In another embodiment, the port component can include one, two or more pieces including a threaded component such as a nut, hollow bolt or threaded insert defining the acoustic port, where the nut or a similar mechanical fastener couples the threaded insert to the drum body side wall to define the acoustic port extending through the drum shell. The acoustic port can have an outer portion or extension that protrudes along the longitudinal axis of the acoustic port to define the extension along an inner surface of the acoustic port. In either embodiment, an angle of the longitudinal axis may be between about 20 and about 70 degrees with respect to the separate component.

The acoustic port extension extends circumferentially about the longitudinal axis, but not necessarily at a complete circumferential angle of 360 degrees. In some examples, the circumferential angle can be about 270 degrees or less, as defined at the drum body side wall. The circumferential angle can decrease with radial or transverse distance from the drum body side wall, as defined along the longitudinal axis of the acoustic port, so that the extension tapers to a point or rounded end. In particular embodiments, the circumferential angle is about 180 degrees or between 150 degrees and 210 degrees at the drum body side wall, and the port extension extends about halfway around the circumference of the port, tapering with distance from the drum shell along the longitudinal port axis. However, other circumferential angles are also contemplated, for example between 90 degrees and 180 degrees, or between 0 degrees and 270 degrees, or less than 270 degrees, or between 100 degrees and 200 degrees. The tapered length of the extension also varies, for example with the taper extending for about the width or thickness of the drum body side wall, or for about twice or three times the width or thickness of the drum body side wall. Alternatively the taper length of the port extension may be more or less, for example between the thickness of the drum body side wall and half the thickness of the drum body side wall, or more than three times the thickness of the drum body side wall.

The drum body side wall can define first and second open ends at opposite sides of the drum body, the coupling structures adapted for engaging respective sets of tension rods to secure first and second drum heads and rim assemblies to the first and second open ends of the drum body, respectively, with the drum heads in tensioned engagement therebetween. The coupling structures may comprise first and second sets of tension lug bodies formed of the substantially continuous material and disposed along upper and lower perimeters of the drum body side wall proximate the first and second open ends of the drum body, respectively, the first and second sets of lug bodies adapted for engaging the respective sets of tension rods to secure the first and second drum heads and rim assemblies.

One or more through-mount structures can be adapted for mounting for a snare assembly to the drum body side wall, the snare assembly configured to engage one or more snares across the second drum head, in acoustic communication therewith. The through-mounts may comprise first and second sets of through holes adapted for mounting a snare strainer and butt plate on generally opposite sides of the drum body side wall, the butt plate configured for extending the snares across the second drum head and the snare strainer configured for engaging the snares therewith.

A percussion instrument may be provided, comprising: a drum body formed of an integral material, the drum body having a drum shell defining a side wall; a resonant chamber defined within the drum shell; and a plurality of tension lug bodies formed of the integral material, the tension lug bodies disposed about a circumference of the drum body side wall and adapted for coupling a drum head across an open end of the drum shell defined along a perimeter of the drum body side wall, the drum head in acoustic communication with the resonant chamber.

A plurality of flanges can be formed of the integral material, extending from the respective tension lug bodies in acoustic and mechanical coupling with an outer surface of the drum shell, the flanges defining a substantially smooth and continuous curvature therebetween. A plurality of tension rods may be engaged with the tension lug bodies disposed about the circumference of the drum body side wall, the tension rods adapted to couple the drum head in tensioned engagement across the open end of the drum shell. A rim assembly can be coupled to the tension rods along the perimeter of the drum body side wall, the rim assembly adapted to couple the drum head across the open end of the drum shell.

A perimeter reinforcement comprised of the integral material can also be provided, e.g., extending from the drum shell along the perimeter of the drum body side wall. A rim coupling or bearing edge can extend along or adjacent the perimeter reinforcement, the bearing edge adapted to secure the drum head in tensioned engagement along the perimeter of the drum body side wall between the rim assembly and the rim coupling or bearing edge. One or more snare beds can be disposed along or defined within the bearing edge, e.g., at opposite sides thereof, and adapted for engagement of a snare assembly across the drum body, with one or more snares in acoustic coupling with the drum head.

A plurality of mechanical inserts can be disposed in the tension lug bodies, the mechanical inserts configured for engagement with the respective tension rods to couple the drum head across the open end of the drum shell. For example, the mechanical inserts can be secured within longitudinal channels extending along the respective tension lug bodies, each of the longitudinal channels having a first end adapted for receiving one of the mechanical inserts in rotationally fixed engagement against a stop, and a second end adapted for engagement of the insert with a respective tension rod. In some embodiments, each of the mechanical inserts comprises a first portion adapted for conformance with a cross-sectional geometry of the respective longitudinal channel in the rotationally fixed engagement against the stop, and a second portion adapted for threaded engagement with the respective tension rod.

One or more acoustic ports can also be provided, extending through the drum shell along a longitudinal axis, e.g., wherein the integral material protrudes from the drum shell along the longitudinal axis to define an extension of the acoustic port. The longitudinal axis of the acoustic port can define an angle between about 30 and about 60 degrees with respect to the drum shell.

The drum body side wall typically defines first and second open ends at opposite sides of the drum body, with the coupling structures adapted for engaging respective sets of the tension rods to secure first and second rim assemblies to the first and second open ends of the drum body with respective first and second drum heads in tensioned engagement therebetween. One or more through-mounts can be adapted for mounting for a snare assembly to the drum body side wall, the snare assembly configured to engage one or more snares across the second drum head, in acoustic communication therewith.

The integral material of the drum body or drum shell may comprise a substantially continuous polymer or matrix material. The integral material may further comprise reinforcing fiber materials.

Suitable methods of forming an integral drum body can also be provided, e.g., comprising one or more steps of: forming a drum body of a substantially continuous material, the drum body having a drum shell defining a resonant chamber; forming a plurality of tension lug bodies of the substantially continuous material, the tension lug bodies disposed about a circumference of the drum shell in acoustic and mechanical coupling therewith; and adapting the tension lug bodies for engaging a drum head across an open end of the drum shell defined along a perimeter thereof, in acoustic communication with the resonant chamber. Flanges can also be formed of the substantially continuous material, the flanges extending from one or more of the tension lug bodies along an outer surface of the drum shell, in acoustic and mechanical coupling therewith.

The method may further comprise any one or more steps of: engaging a plurality of tension rods with the tension lug bodies disposed about the circumference of the drum shell; coupling the tension rods with a rim assembly; and adjusting the tension rods to couple the drum head across the open end of the drum shell in tensioned engagement between the rim assembly and the drum body, along the circumference of the drum shell. Additional methods may comprise forming a perimeter reinforcement of the substantially continuous material extending from the drum shell along the perimeter defining the open end thereof; or forming a rim coupling or bearing edge of the substantially continuous material extending along one or both of the perimeter of the drum shell and the perimeter reinforcement, the bearing edge adapted to couple a rim assembly in compressive engagement with the open end of the drum body with the drum head disposed therebetween. One or more snare beds can be disposed along or defined in the bearing edge, in order to couple a snare assembly to the drum body with a plurality of snares in tensioned engagement against such a drum head, e.g., on the bottom of the drum body, opposite a playing head on the top of the drum body.

Depending on application, the method may further comprise one or more of: disposing a plurality of mechanical inserts in the tension lug bodies, the mechanical inserts adapted to engage with a plurality of tension rods to couple the drum head across the open end of the drum shell; inserting the mechanical inserts into longitudinal channels defined along the tension lug bodies and seating the mechanical inserts therein, wherein the mechanical inserts are disposed in rotationally fixed engagement within the respective tension lug bodies; and coupling the tension rods in threaded engagement with the respective mechanical inserts.

In some embodiments, the method includes defining an acoustic port through the drum shell and extending the acoustic port along a longitudinal axis thereof, wherein the substantially continuous material protrudes from the drum shell along the longitudinal axis of the acoustic port. An angle of the longitudinal axis may be between about 20 and about 70 degrees with respect to the drum shell.

In other embodiments, the method includes defining an acoustic port through a separate part that is independent of the drum system, and attaching the separate part containing the acoustic port to the drum body.

Forming the drum body can also include defining first and second open ends of the drum shell at opposite sides of the drum body, and adapting the coupling structures for engaging respective sets of tension rods to secure first and second rim assemblies to the first and second open ends of the drum body, e.g., with first and second drum heads in tensioned engagement therebetween.

Forming the drum body can further include defining an aperture through the drum body side wall, such that the drum body side wall can engage a separate part containing an acoustic port.

Suitable methods can further comprise forming the drum body and tension lugs by volume printing the substantially continuous material, e.g., wherein the substantially continuous material comprises a polymer matrix, a fiber reinforcement material, a composite polymer material, graphite, a metal or metal alloy, or a combination thereof. The acoustic response of the resonant chamber can be tuned or modulated by adjusting a thickness of the drum shell, by adjusting a mass of the tension lug bodies, or both.

This disclosure describes exemplary embodiments of the invention, which can be adapted to a range of different applications. Changes can be made and various equivalents may be substituted without departing from the spirit and scope of the inventive concept. Modifications can also be made to adapt these teachings to different problems and situations, and to the use of other materials, techniques and methods, as known in the art. The scope of invention is thus not limited to the particular examples that are disclosed, but encompasses all of the embodiments falling within the scope of the appended claims.

What is claimed is:

1. A method of manufacturing a drum shell, the method comprising:

forming and shaping a drum shell from a substantially continuous and homogeneous material wherein the drum shell comprises an integral drum body having a side wall defining a resonant chamber with acoustic response related to size and thickness of the side wall and a mass distribution of the integral drum body;

shaping the side wall to define a top perimeter region and a bottom region of the integral drum body, wherein the top perimeter region defines a top opening to the resonant chamber and the bottom region defines a bottom of the resonant chamber, opposite the top perimeter region;

controlling one or both of the side wall thickness or mass distribution of the substantially continuous and homogeneous material, wherein one or both of the side wall thickness and the mass distribution is adapted to modulate the acoustic response;

forming a plurality of tension lug bodies integral with the drum shell, wherein the tension lug bodies are disposed about a circumference of the side wall and adapted for engaging a drum head across the top opening to the resonant chamber;

forming or machining a channel within each of the plurality of tension lug bodies, wherein each of the channels is adapted for engaging a threaded nut, lug, or mechanical insert configured to secure a drum head across the top opening to the resonant chamber; and engaging one such insert within each of the respective channels with a heat set process, or embedding the insert into the respective tension lug body wherein the substantially continuous and homogeneous material reaches a plastic phase transition temperature.

2. The method of claim 1, further comprising selecting the mass distribution of the drum shell to modulate the acoustic response.

3. The method of claim 1, further comprising defining an acoustic port within the side wall of the drum shell, wherein the acoustic port extends at a non-orthogonal skew or acute angle through the side wall of the drum shell and has a diameter sized to modulate the acoustic response.

4. The method of claim 1, further comprising forming or machining an acoustic port along a longitudinal axis extending through the side wall of the integral drum body, wherein the longitudinal axis extends at a non-orthogonal skew or acute angle with respect to the side wall, or along a protrusion of the acoustic port extending radially inward or radially outward from the side wall, or both.

5. The method of claim 1, further comprising mounting or forming a snare strainer on the side wall of the integral drum body, the snare strainer configured to engage one or more snares across a drum head coupled to the integral drum body across the bottom of the resonant chamber.

6. The method of claim 1, further comprising coupling a drum head to the integral drum body across the top opening to the resonant chamber with a top rim assembly, wherein the top rim assembly is held in tensioned engagement with the top perimeter region of the side wall by a plurality of tension mechanisms, the plurality of tension mechanisms coupling the top rim assembly to a plurality of lugs distributed about a circumference of the side wall.

7. The method of claim 1, further comprising forming a perimeter reinforcement on the drum shell by extending the substantially continuous and homogeneous material of the integral drum body radially inward from the side wall adjacent the top perimeter region or the bottom region, the perimeter reinforcement configured to provide structural support to the side wall.

8. The method of claim 1, wherein the side wall is substantially cylindrical or substantially frustoconical and/or further comprising defining a beveled bearing edge along the top perimeter region or the bottom region, wherein the beveled bearing edge is adapted to secure a drum head in tensioned engagement to the integral drum body with a desired acoustic response.

9. The method of claim 1, wherein the channels are adapted to secure the inserts by conforming with an outer geometry of the insert.

10. A drum shell manufactured according to the method of claim 1, wherein the side wall is substantially cylindrical or substantially frustoconical and the substantially cylindrical or substantially frustoconical side wall has a thickness or mass distribution defined by the substantially continuous and homogeneous material to modulate the acoustic response of the drum shell.

11. The drum shell of claim 10, wherein the substantially continuous and homogeneous material comprises a polymer, plastic or composite material.

12. The drum shell of claim 10, further comprising a reinforcement formed of the substantially continuous and homogeneous material, the reinforcement extending circumferentially about the drum shell radially inward or radially outward from the side wall.

13. The drum shell of claim 10, further comprising an acoustic port defined in the substantially continuous and homogeneous material, such that the acoustic port is in pressure communication between the resonant chamber and an exterior of the drum shell.

14. The drum shell of claim 10, further comprising an insert disposed in each of the coupling structures, the insert adapted for engaging a tensioning mechanism for coupling the drum head to the integral drum body along the top perimeter region of the side wall.

15. The drum shell of claim 14, wherein the insert is secured by conforming an outer geometry of the insert within a channel machined or formed in each of the respective coupling structures, and/or embedded within the respective coupling structure by a heat set process.

16. A drum shell comprising:

an integral drum body having a side wall defining a resonant chamber, wherein the integral drum body is formed by an additive manufacturing process or with a volume printing material that shapes the side wall to define an acoustic response of the drum shell; and a top perimeter region and a bottom region of the integral drum body, wherein the top perimeter region defines a top opening to the resonant chamber and the bottom region defines a bottom of the resonant chamber, opposite the top perimeter region;

wherein the side wall is substantially cylindrical or substantially frustoconical and the substantially cylindrical or substantially frustoconical side wall has a thickness or mass distribution controlled by the additive manufacturing process or defined by the volume printing material to modulate the acoustic response of the drum shell; and an acoustic port defined in the volume printing material or by the additive manufacturing process, the acoustic port in pressure communication between the resonant chamber and an exterior of the drum shell;

wherein the acoustic port extends along an axis defining a skew or acute angle with respect to the side wall of the drum shell, and further comprising a protrusion extending radially inward or radially outward from the side wall, or both, along the axis of the acoustic port.

17. A method of forming a drum shell from a substantially continuous and homogeneous material according to claim 16, the method comprising:

forming the substantially continuous and homogeneous material into a shape of the integral drum shell, wherein the integral drum shell comprises the integral drum body having the side wall defining the resonant chamber; and controlling the thickness or mass distribution of the substantially continuous and homogeneous material of the side wall to modulate the acoustic response of the drum shell.

18. The method of claim 17, further comprising forming a plurality of coupling structures with the substantially continuous and homogeneous material, wherein the coupling structures are disposed about a circumference of the drum shell along a perimeter of the side wall, and adapted for engaging a drum head across the top opening to the resonant chamber.

19. The method of claim 17, wherein the drum shell is formed by a single-step manufacturing process, and the method further comprising:

forming a plurality of tension lugs about a circumference of the drum shell along a perimeter of the side wall, by the single-step manufacturing process; or coupling a plurality of tension lugs to the drum shell, along the perimeter of the side wall.

20. The method of claim 17, further comprising forming or machining the acoustic port in the substantially continuous and homogeneous material, wherein the protrusion extends radially inward or radially outward from the side wall, or both, along the axis of the acoustic port.

21. The method of claim 19, further comprising engaging an insert within each of the tension lugs and securing the insert by the tension lug conforming with an outer geometry of the insert, and/or by embedding the insert within the respective tension lug.

* * * * *